US008007872B2

(12) United States Patent
Nakazono et al.

(10) Patent No.: US 8,007,872 B2
(45) Date of Patent: Aug. 30, 2011

(54) ELECTROSTATIC COATING METHOD AND APPARATUS FOR THE SAME

(75) Inventors: Daisuke Nakazono, Tochigi (JP); Takashi Wakimoto, Tochigi (JP); Hiroki Matsunaga, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 188 days.

(21) Appl. No.: 12/442,604

(22) PCT Filed: Oct. 1, 2008

(86) PCT No.: PCT/JP2008/068250

§ 371 (c)(1),
(2), (4) Date: Mar. 24, 2009

(87) PCT Pub. No.: WO2009/051039

PCT Pub. Date: Apr. 23, 2009

(65) Prior Publication Data

US 2010/0183817 A1 Jul. 22, 2010

(30) Foreign Application Priority Data

Oct. 16, 2007 (JP) ..... 2007-269471

(51) Int. Cl.
*B05D 1/04* (2006.01)
*B05B 5/025* (2006.01)

(52) U.S. Cl. ..... 427/483; 427/458; 427/475; 118/621; 118/629; 118/630; 118/633

(58) Field of Classification Search ..... 427/458, 427/475, 483; 118/621, 629, 630, 633
See application file for complete search history.

(56) References Cited

U.S. PATENT DOCUMENTS 6,284,047 B1 * 9/2001 Yoshida et al. ..... 118/629
2006/0177592 A1 * 8/2006 Takebe et al. ..... 427/458

FOREIGN PATENT DOCUMENTS

JP 2006-346596 12/2006

* cited by examiner

*Primary Examiner* — Frederick Parker

(74) *Attorney, Agent, or Firm* — Rankin, Hill & Clark LLP

(57) ABSTRACT

An electrostatic coating method in which a coating material cartridge is used. When a coating material feeding path (68, 88) is cleaned by a liquid fed from a coating material feeding unit (20), the liquid is fed from the coating material feeding unit to a storage part (13) and stored. The liquid in the storage part is then fed to a fluid chamber (83) inside a coating material cartridge (19) via a fluid circuit (10A). The liquid in the fluid chamber pushes out the electrically conductive coating material inside a coating material chamber (84) via a free piston (82), and the electrically conductive coating material is fed to a coating gun (14).

7 Claims, 16 Drawing Sheets

16

15a
115
71
B
121
102
101
124
95
125
106
106
125
96c
102c
96
104
129
106
106
129
C
128
98
126
74
97
103
116
15b

ELECTROSTATIC COATING METHOD AND APPARATUS FOR THE SAME

TECHNICAL FIELD

The present invention relates to an improved electrostatic coating method and electrostatic coating apparatus.

BACKGROUND ART

An electrostatic coating system in which the water fed from a water feeding device is purified water, and a coating material in a coating material cartridge installed in a coating gun is pushed out by the purified water and sprayed from a coating material nozzle to apply a coating is disclosed in Japanese Patent Application Laid-Open Publication No. 2006-346596.

FIG. 18 hereof shows the coating system disclosed in the 2006-346596 publication.

The coating system 200 is provided with a purified water feeding device 201 and a coating gun 211.

The purified water feeding device 201 is composed of a water feeding device 204, a discharge quantity control device 205, and a purified water production device 206.

The coating gun 211 is composed of a coating gun main body 212 and a coating material tank unit 213 as a coating material cartridge that is detachably attached to the coating gun main body 212. The coating material tank unit 213 is provided with a coating material chamber 215 for storing a coating material, a coating material nozzle 216 communicated with the coating material chamber 215, and an ejection liquid chamber 217 to which the abovementioned purified water is fed. The coating material chamber 215 and the ejection liquid chamber 217 are partitioned from each other by a piston 218.

When purified water is fed to the ejection liquid chamber 217 from the purified water feeding device 201, the purified water pushes the piston 218 and ejects the coating material inside the coating material chamber 215, and causes the coating material to be sprayed from the coating material nozzle 216.

However, in the coating system described above, the coating material tank unit 213 must be replaced at each coating operation when handling an electrically conductive coating material of a color frequently used for coating, the amount of labor involved in coating increases, and the work of coating is inefficient. Cost therefore increases.

DISCLOSURE OF THE INVENTION

An object of the present invention is to provide an electrostatic coating method and apparatus for the same whereby cost is reduced, and coating can be performed with good efficiency.

The first aspect of the present invention provides an electrostatic coating method wherein a coating material feeding path for feeding an electrically conductive coating material or a fluid from a coating material feeding unit to a coating gun has a storage part for temporarily storing the electrically conductive coating material or the fluid and pushing out the stored electrically conductive coating material or the fluid toward the coating gun, and an insulating part for providing an electrical shield between the coating material feeding unit and the storage part; a fluid circuit is provided between the storage part and the coating gun; a coating material cartridge is detachably connected to the fluid circuit; and electrostatic coating is performed by applying a high voltage when the electrically conductive coating material is fed from the storage part via the fluid circuit, or applying a high voltage when the electrically conductive coating material is fed from the coating material cartridge via the fluid circuit, and feeding to the coating gun the electrically conductive coating material to which the high voltage is applied; and the electrostatic coating method comprises the steps of feeding the fluid from the coating material feeding unit to the storage part and storing the fluid when the electrically conductive coating material loaded into a coating material chamber inside the coating material cartridge is fed to the coating gun; and feeding the fluid in the storage part via the fluid circuit to a fluid chamber that is separated from the coating material chamber by a free piston in the coating material cartridge, whereby the free piston is pushed out toward the coating material chamber, and the electrically conductive coating material in the coating material chamber is fed to the coating gun by the movement of the free piston.

When the coating material feeding path is cleaned by liquid fed from the coating material feeding unit, the liquid is fed from the coating material feeding unit to the storage part and stored. The liquid inside the storage part is then fed to the fluid chamber in the coating material cartridge via the fluid circuit. As a result, the liquid in the fluid chamber pushes out the electrically conductive coating material in the coating material chamber via the piston, and the electrically conductive coating material is fed to the coating gun.

At this time, since the electrically conductive coating material in the coating material cartridge is pushed out by the liquid used to clean the coating material feeding path, there is no need to provide a special fluid feeding part for pushing out the electrically conductive coating material in the coating material cartridge, a power source for the fluid feeding part, or a storage part that includes the power source. Furthermore, since the electrically conductive coating material in the coating material cartridge is pushed out when the coating material feeding path is cleaned by the liquid, there is also no need for a special method for pushing out the coating material.

The first aspect of the present invention has a step of feeding the liquid from the coating material feeding unit to the storage part and storing the liquid when the electrically conductive coating material loaded into a coating material chamber inside the coating material cartridge is fed to the coating gun; and a step of feeding the liquid in the storage part via the fluid circuit to a fluid chamber that is separated from the coating material chamber by a free piston in the coating material cartridge, whereby the free piston is pushed out toward the coating material chamber, and the electrically conductive coating material in the coating material chamber is fed to the coating gun by the movement of the free piston. Therefore, the liquid fed from the coating material feeding unit can be used to feed the electrically conductive coating material in the coating material cartridge to the coating gun; there is no need to provide a fluid feeding part for feeding liquid specifically for the coating material cartridge, a power source for the fluid feeding part, or a storage part that is provided with the power source; and cost can be reduced.

Since liquid can be fed from the coating material feeding unit to the coating material cartridge in the same manner that the coating material feeding path is cleaned by the liquid fed from the coating material feeding unit, and there is no need to provide a special method for pushing out the coating material in the coating material cartridge, electrostatic coating can be efficiently performed.

Another aspect of the present invention provides an electrostatic coating apparatus wherein a coating material feeding path for feeding an electrically conductive coating material or a fluid from a coating material feeding unit to a coating gun has a storage part for temporarily storing the electrically conductive coating material or the fluid and pushing out the stored electrically conductive coating material or the fluid toward the coating gun, and an insulating part for providing an electrical shield between the coating material feeding unit and the storage part; and electrostatic coating is performed by feeding to the coating gun the electrically conductive coating material to which a high voltage is applied, or the coating material feeding path is cleaned by feeding the fluid to the coating gun; and in the electrostatic coating apparatus, a fluid circuit is provided between the storage part and the coating gun, and a coating material cartridge is detachably connected to the fluid circuit; a free piston is provided inside the coating material cartridge so as to be able to move, whereby the coating material cartridge is partitioned into a fluid chamber to which the fluid is fed, and a coating material chamber into which the electrically conductive coating material is loaded; and the electrically conductive coating material inside the coating material chamber is pushed out by the free piston and fed to the coating gun by feeding the fluid that has been fed from the coating material feeding unit and stored in the storage part to the fluid chamber of the coating material cartridge via the fluid circuit.

When the electrically conductive coating material loaded into the coating material chamber in the coating material cartridge is fed to the coating gun, first, the liquid is fed from the coating material feeding unit to the storage part and stored, and then the liquid in the storage part is fed to the fluid chamber in the coating material cartridge via the fluid circuit. As a result, the liquid inside the fluid chamber pushes out the electrically conductive coating material in the coating material chamber via the piston, and the electrically conductive coating material is fed to the coating gun.

At this time, since the electrically conductive coating material in the coating material cartridge is pushed out by the liquid used to clean the coating material feeding path, there is no need to provide a special power source or a storage part that includes the power source for pushing out the electrically conductive coating material in the coating material cartridge.

According to this other aspect of the present invention, a fluid circuit is provided between the storage part and the coating gun, and a coating material cartridge is detachably connected to the fluid circuit; a free piston is provided inside the coating material cartridge so as to be able to move, whereby the coating material cartridge is partitioned into a fluid chamber to which the liquid is fed, and a coating material chamber into which the electrically conductive coating material is loaded; and the electrically conductive coating material inside the coating material chamber is pushed out by the free piston and fed to the coating gun by feeding the liquid that has been fed from the coating material feeding unit and stored in the storage part to the fluid chamber of the coating material cartridge via the fluid circuit. The liquid fed from the coating material feeding unit can therefore be used to feed the electrically conductive coating material in the coating material cartridge to the coating gun; there is no need to provide a fluid feeding part for feeding liquid specifically for the coating material cartridge, a power source for the fluid feeding part, or a storage part that is provided with the power source; and cost can be reduced.

Preferably, in the electrically conductive coating apparatus of the present invention, a flow path switching device is provided to the fluid circuit; and the flow path switching device has a first inlet and a second inlet into which the fluid flows; a first outlet and a second outlet out of which said fluid flows; a first cylinder hole communicated with the first inlet; a second cylinder hole communicated with the first inlet and the second outlet; a third cylinder hole communicated with the first outlet; a fourth cylinder hole communicated with the first outlet and the second inlet; an inter-cylinder hole passage for connecting each of the first cylinder hole and the third cylinder hole; a first valve, a second valve, a third valve, and a fourth valve that are movably inserted in the first cylinder hole, the second cylinder hole, the third cylinder hole, and the fourth cylinder hole, respectively; and urging means for urging each of the first valve, the second valve, the third valve and the fourth valve in the closing direction; wherein the first valve opens and closes a passage between the first cylinder hole and the first inlet, the second valve opens and closes a passage between the second cylinder hole and the first inlet, the third valve opens and closes a passage between the third cylinder hole and the first outlet, and the fourth valve opens and closes a passage between the fourth cylinder hole and the first outlet.

By opening the first valve and the second valve, the electrically conductive coating material that has flowed in from the first inlet can be discharged from the first outlet through the first cylinder hole, the inter-cylinder hole passage, and the third cylinder hole, and by opening the second valve and the fourth valve, the electrically conductive coating material that has flowed in from the first inlet can be discharged from the second inlet, and the electrically conductive coating material that has flowed in from the second inlet can be discharged from the first outlet. The flow path of the electrically conductive coating material can therefore be easily switched by appropriately selecting the opening and closing of each valve by a simple structure.

Preferably, the urging means has springs for pushing each of the first valve, the second valve, the third valve, and the fourth valve closed, and further has pressurized fluid that is fed to each of the first cylinder hole, the second cylinder hole, the third cylinder hole, and the fourth cylinder hole.

The flow path switching device thus controls the feeding or stopping of pressurized fluid to the first cylinder hole, the second cylinder hole, the third cylinder hole, and the fourth cylinder hole, whereby the first valve, the second valve, the third valve, and the fourth valve can be easily pushed open by the electrically conductive coating material, water W, cleaning fluid, or another fluid; the flow path of the electrically conductive coating material or the fluid can easily be switched; and cost can be minimized by the simplicity of the structure.

Preferably, in the electrically conductive coating apparatus of the present invention, a flow path switching device is provided to the fluid circuit; the flow path switching device has a first inlet and a second inlet into which the fluid flows; a first outlet and a second outlet out of which said fluid flows; a first cylinder hole communicated with the first inlet and the second outlet; a second cylinder hole communicated with the first outlet and the second inlet; a connecting hole for connecting each of the first cylinder hole and the second cylinder hole; a first valve and a second valve movably inserted into the first cylinder hole and the second cylinder hole, respectively; and actuators for moving each of the first valve and the second valve in at least one direction; wherein the first valve opens and closes a passage between the first inlet and the connecting hole, and between the first inlet and the second outlet, and the second valve opens and closes a passage between the connecting hole and the first outlet, and between the second inlet and the first outlet.

The flow path switching device is capable of easily switching the flow path of the electrically conductive coating material or the liquid by the operation of the actuators, and has a simple structure. The cost can therefore be minimized.

Preferably, the actuators are a pair including a first actuator and a second actuator for moving the first valve and the second valve, respectively.

Since the first valve is moved by the first actuator, and the second valve is moved by the second actuator, the flow path can be reliably and rapidly switched.

Preferably, the coating gun and the flow path switching device are mounted on an arm of an articulated robot capable of freely varying the spray direction of the electrically conductive coating material in the coating gun.

The flow path switching device can be placed close to the coating gun, and the coating material cartridge can also be placed on the arm of the articulated robot so that the coating material cartridge is positioned in the vicinity of the flow path switching device. Consequently, the distance from the coating material cartridge to the coating gun can be reduced, and the amount of the electrically conductive coating material that remains in the channel from the coating material cartridge to the coating gun can be reduced.

BEST MODE FOR CARRYING OUT THE INVENTION

Several preferred embodiments of the present invention are described below with reference to the attached drawings.

Figure 1:
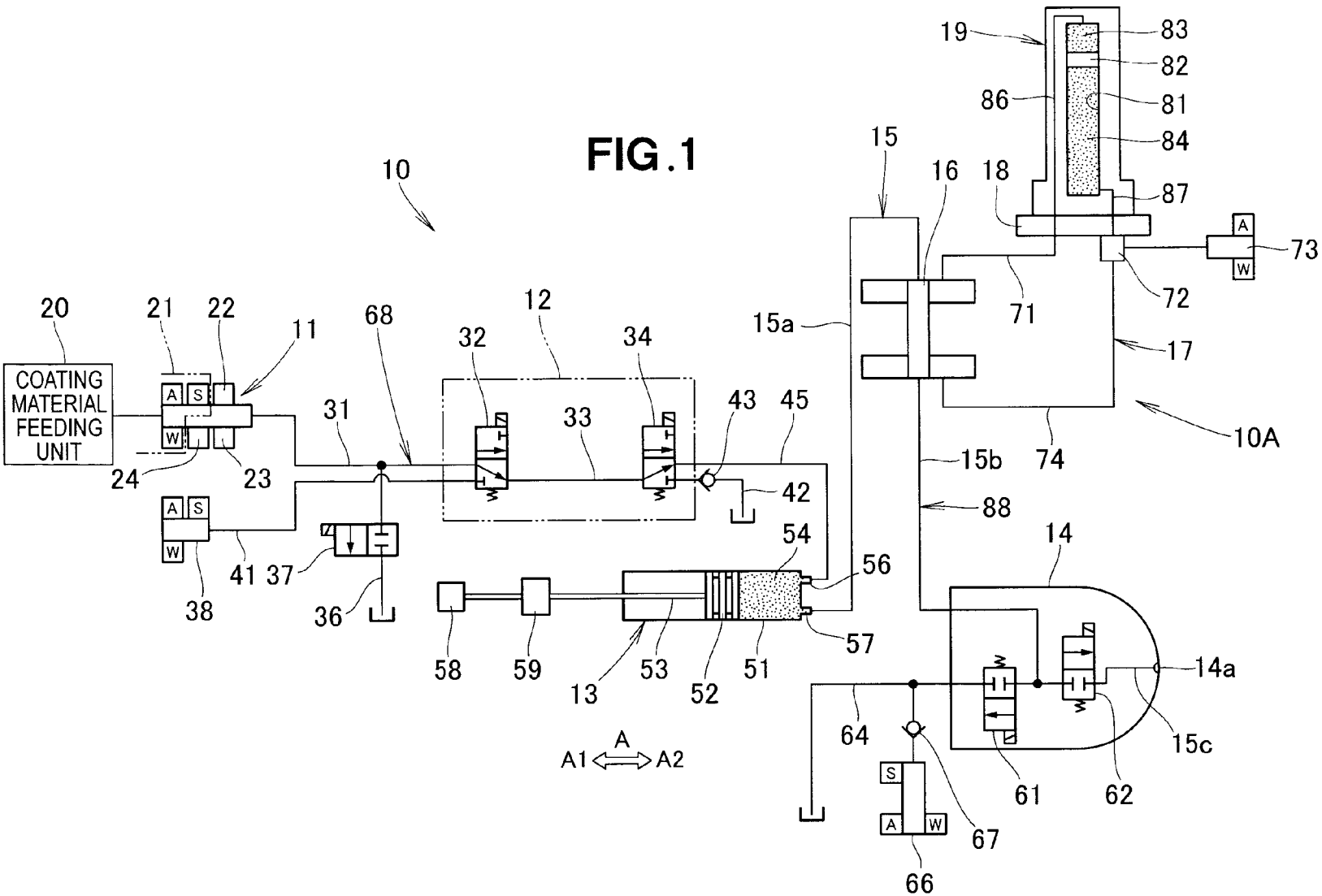
FIG. 1 is a fluid circuit diagram showing an electrostatic coating device according to the present invention.

As shown in FIG. 1, the electrostatic coating apparatus 10 is connected to a coating material feeding unit 20 for feeding a plurality of different colors of an electrically conductive coating material, and is composed of a color switch valve mechanism 11 for switching the feeding of the electrically conductive coating materials; a block valve mechanism 12 for electrically insulating the color switch valve mechanism 11 from a coating gun 14; a delivery path 15 for connecting between a storage tank 13 and the coating gun 14; a switching valve 16 provided to the delivery path 15; a intermediate path 17 connected to the switching valve 16; and a coating material cartridge 19 detachably attached to a cartridge stage 18 provided to the intermediate path 17.

The delivery path 15 is composed of a first delivery path 15*a* extending from the storage tank 13 to the switching valve 16; a second delivery path 15*b* extending from the switching valve 16 to the coating gun 14 (specifically, to a trigger valve 62); and a third delivery path 15*c* toward the distal end (including a spray opening 14*a*) from the trigger valve 62 of the coating gun 14.

The color switch valve mechanism 11 is composed of a first cleaning valve 21 for controlling feeding of drying air A, water W, and cleaning liquid S; and coating material valves 22, 23, 24 for controlling the feeding of the electrically conductive coating materials, the coating material valves 22, 23, 24 being connected to the coating material feeding unit 20 for feeding the plurality of different colors of electrically conductive coating material.

The block valve mechanism 12 is composed of a switching valve 32 connected to the color switch valve mechanism 11 via a feeding path 31; and a switching valve 34 connected to the switching valve 32 via a feeding path 33 as an electrically insulating duct made of resin.

A first drainage path 36 is connected to the feeding path 31 via a first dump valve 37. A second cleaning valve 38 for controlling the feeding of the air A, water W, and cleaning liquid S is connected to the switching valve 32 via a feeding path 41. A second drainage path 42 is connected to the switching valve 34 via a one-way valve 43.

The switching valve 32 switches between the direction of the color switch valve mechanism 11 and the direction of the second cleaning valve 38.

The switching valve 34 switches between the direction of the second drainage path 42 and the direction of the storage tank 13 connected via a feeding path 45.

The storage tank 13 is composed of a cylinder 51, a piston 52 inserted in the cylinder 51 so as to be able to move, a rod 53 attached to the piston 52, a cylinder chamber 54 formed by the cylinder 51 and the piston 52, and an injection hole 56 and a discharge hole 57 that are communicated with the cylinder chamber 54 and provided at the end of the cylinder 51.

The rod 53 is connected to a servo motor 58 via a ball screw means 59. The rod 53 and the piston 52 are moved back and forth in the axial direction of the cylinder (the direction of the arrow A) via the ball screw means 59 by the driving of the servo motor 58.

The coating gun 14 is provided with a second dump valve 61 and the trigger valve 62 that are connected to the switching valve 16 via the second delivery path 15*b*. The coating gun 14 is connected to a high-voltage applying means not shown in the drawing. The spray opening 14*a* of the coating gun 14 forms the end of the delivery path 15.

The second dump valve 61 is connected to a third discharge path 64 for discharging waste liquid that includes cleaning liquid and electrically conductive coating material that is generated during cleaning to the outside of the delivery path 15. The third discharge path 64 is connected via a one-way valve 67 to a third cleaning valve 66 for controlling the feeding of the air A, water W, and cleaning liquid S.

The trigger valve 62 controls spraying of the electrically conductive coating material from the coating gun 14.

The feeding paths 31, 33, 45, the storage tank 13, the first delivery path 15*a*, the second delivery path 15*b*, and the switching valve 16 described above form a main coating material feeding path 68 that extends from the coating material feeding unit 20 to the coating gun 14.

The switching valve 16 switches between a coating material feeding path for feeding the electrically conductive coating material to the coating gun 14 when the electrically conductive coating material is stored in the storage tank 13, and a fluid/coating material feeding path for feeding water W or cleaning liquid S to the coating material cartridge 19 when water W or cleaning liquid S is stored in the storage tank 13 and feeding the electrically conductive coating material in the coating material cartridge 19 to the coating gun 14.

The intermediate path 17 is composed of the cartridge stage 18; a feeding path 71 connected to each of the cartridge stage 18 and one end of the switching valve 16; a three-way valve 72 provided to the output side of the cartridge stage 18; a cleaning valve 73 for controlling feeding of air A and water W, the cleaning valve 73 being connected to the three-way valve 72; and a delivery path 74 connected to each of the three-way valve 72 and the other end of the switching valve 16.

The switching valve 16 and the intermediate path 17 described above constitute a fluid circuit 10A.

The coating material cartridge 19 is provided with a cylinder hole 81; a free piston 82 inserted into the cylinder hole 81 so as to be able to move; a fluid passage 86 for connecting the cartridge stage 18 and the fluid chamber 83 of the fluid chamber 83 and a coating material chamber 84 into which the cylinder hole 81 is partitioned by the free piston 82; and a coating material passage 87 for connecting the cartridge stage 18 and the coating material chamber 84 in the cylinder hole 81.

The coating material passage 87 of the coating material cartridge 19, the cartridge stage 18, the three-way valve 72, the delivery path 74, the switching valve 16, the second delivery path 15*b*, and the third delivery path 15*c* constitute a sub-coating material feeding path 88 that extends from the coating material cartridge 19 to the coating gun 14.

Figure 2:
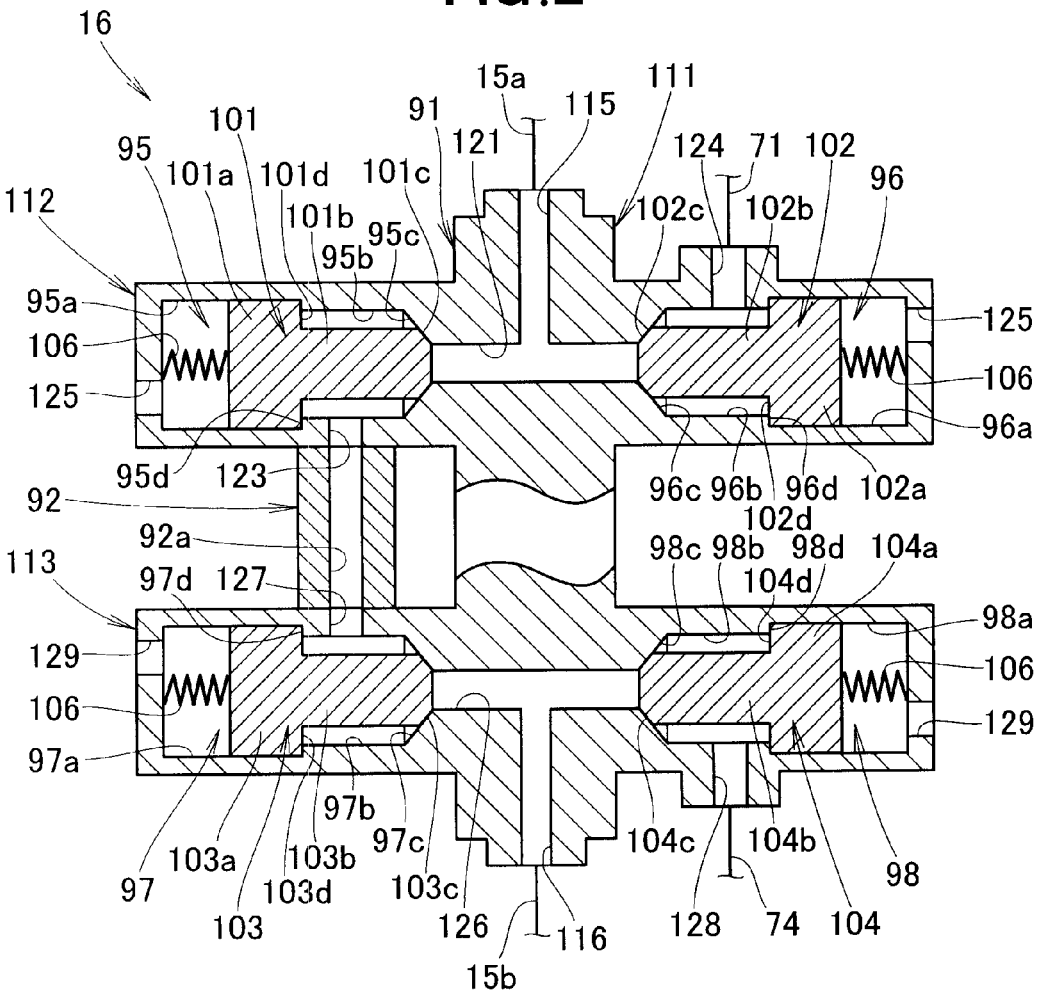
FIG. 2 is a sectional view showing a switching valve of FIG. 1.

FIG. 2 shows the switching valve 16 shown in FIG. 1. The switching valve 16 is composed of a housing 91 in which a plurality of passages is provided; a passage connecting duct 92 that is attached to the housing 91 in order to connect the passages in the housing 91 to each other; first through fourth valves 101 through 104 that are movably inserted into four first through fourth cylinder holes 95 through 98, respectively, formed in the housing 91; and a plurality of springs 106 for urging the first through fourth valves 101 through 104 in the direction of closing the passages.

The housing 91 is a member that is integrally formed with a vertically elongated vertical part 111 and two horizontally elongated horizontal parts 112, 113 that are formed so as to be orthogonal to the vertical part 111.

A first inlet 115 is formed at the top of the vertical part 111, and a first outlet 116 is formed at the bottom of the vertical part 111. The first inlet 115 is connected to the storage tank 13 (FIG. 1) via the first delivery path 15*a*. The first outlet 116 is connected to the coating gun 14 (FIG. 1) via the second delivery path 15*b*.

The horizontal part 112 is provided with a top connecting passage 121 for connecting each of the first cylinder hole 95 and the second cylinder hole 96; a first connecting passage 123 for connecting each of the first cylinder hole 95 and an intra-duct passage 92*a* that is formed in the passage connecting duct 92; a second outlet 124 formed at the top of the second cylinder hole 96; and air feeding ports 125, 125 for feeding air for pushing the first valve 101 and the second valve 102 in the direction of closing the passages into the first cylinder hole 95 and the second cylinder hole 96, respectively.

The second outlet 124 is connected to the feeding path 71.

The horizontal part 113 is provided with a bottom connecting passage 126 for connecting each of the third cylinder hole 97 and the fourth cylinder hole 98; a second connecting passage 127 for connecting each of the third cylinder hole 97 and the intra-duct passage 92*a* of the passage connecting duct 92; a second inlet 128 formed in the bottom of the fourth cylinder hole 98; and air feeding ports 129, 129 for feeding air for pushing the third valve 103 and the fourth valve 104 in the direction of closing the passages into the third cylinder hole 97 and the fourth cylinder hole 98, respectively.

The second inlet 128 is connected to the delivery path 74.

The first valve 101 closes the passage between the first cylinder hole 95 and the top connecting passage 121 through the pressure of the spring 106 and the air fed from the air feeding port 125 to the first cylinder hole 95.

The second valve 102 closes the passage between the second cylinder hole 96 and the top connecting passage 121 by the pressure of the spring 106 and the air fed from the air feeding port 125 to the second cylinder hole 96.

The third valve 103 closes the passage between the third cylinder hole 97 and the bottom connecting passage 126 by the pressure of the spring 106 and the air fed from the air feeding port 129 to the third cylinder hole 97.

The fourth valve 104 closes the passage between the fourth cylinder hole 98 and the bottom connecting passage 126 by the pressure of the spring 106 and the air fed from the air feeding port 129 to the fourth cylinder hole 98.

The first through fourth cylinder holes 95 through 98 are composed of large-diameter holes 95*a* through 98*a* and small-diameter holes 95*b* through 98*b* adjacent to the large-diameter holes 95*a* through 98*a*, respectively, and the small-diameter holes 95*b* through 98*b* have female tapered parts 95*c* through 98*c*, respectively, at the ends on one side thereof.

The reference numerals 95*d* through 98*d* refer to stepped parts formed at the boundaries of the large-diameter holes 95*a* through 98*a* and the small-diameter holes 95*b* through 98*b*.

The first through fourth valves 101 through 104 are composed of large-diameter parts 101*a* through 104*a* that are movably fitted into the large-diameter holes 95*a* through 98*a*; and small-diameter parts 101*b* through 104*b* that are integrally formed with the large-diameter parts 101*a* through 104*a* and formed having an outside diameter smaller than the inside diameter of the small-diameter holes 95*b* through 98*b*; and the first through fourth valves 101 through 104 have male tapered parts 101*c* through 104*c* that are capable of fitting in the female tapered parts 95*c* through 98*c* at the ends on one side of the small-diameter parts 101*b* through 104*b*.

The reference numerals 101*d* through 104*d* refer to stepped parts formed at the boundaries of the large-diameter parts 101*a* through 104*a* and the small-diameter parts 101*b* through 104*b*.

The operation of the electrostatic coating apparatus 10 described above will next be described based on FIGS. 3 through 13.

Figure 3:
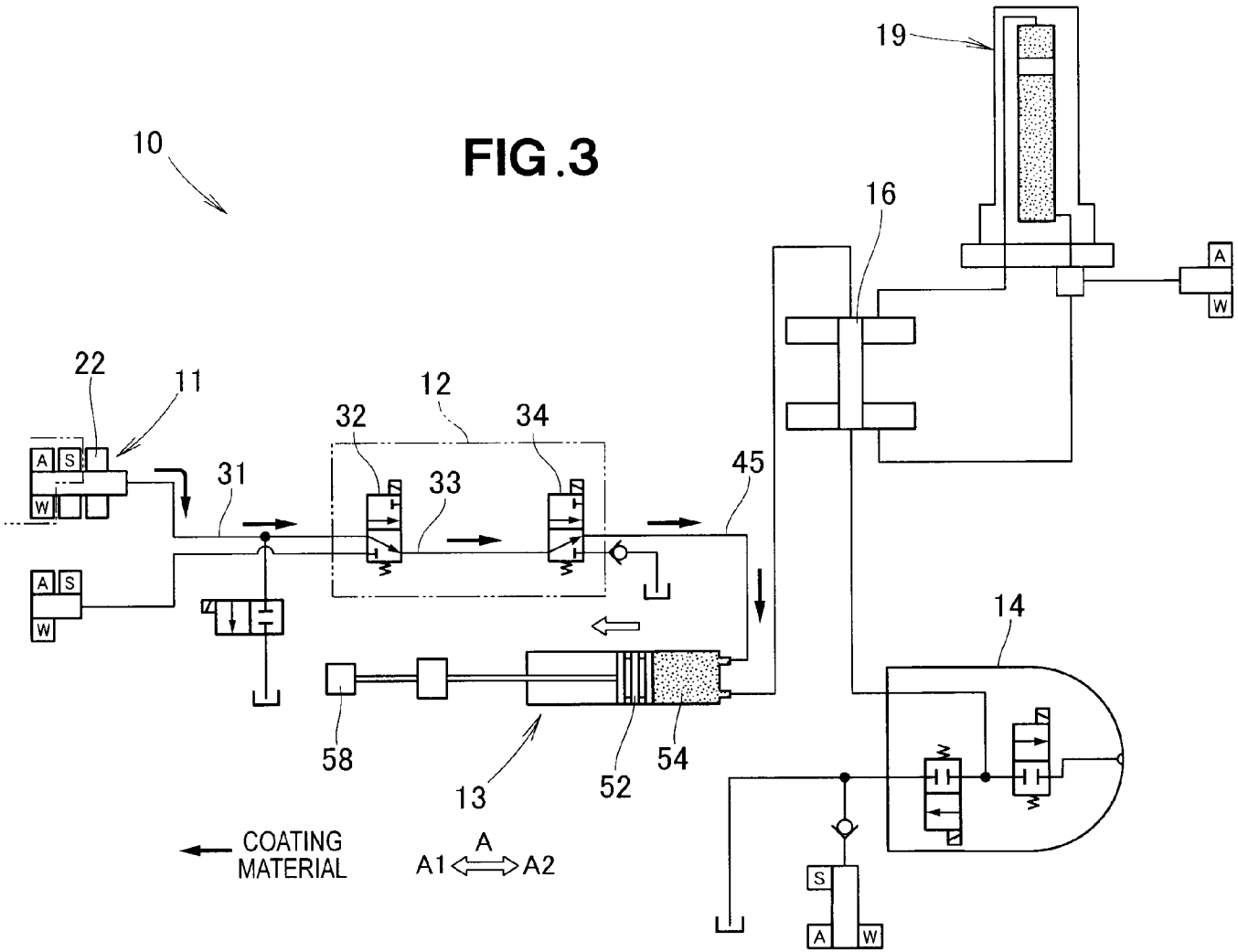
FIG. 3 is a view showing a state in which an electrically conductive coating material is loaded into a storage tank.

FIG. 3 shows a state in which the electrically conductive coating material of a predetermined color is loaded into the storage tank 13.

First, the switching valves 32, 34 of the block valve mechanism 12 open, and in a state in which the coating material valve 22 of the color switch valve mechanism 11 is open, for example, the servo motor 58 of the storage tank 13 is actuated, and the piston 52 is moved in the A1 direction. The predetermined color of electrically conductive coating material is thereby loaded into the cylinder chamber 54 of the storage tank 13 through the feeding paths 31, 33, 45 from the coating material valve 22.

Figure 4:
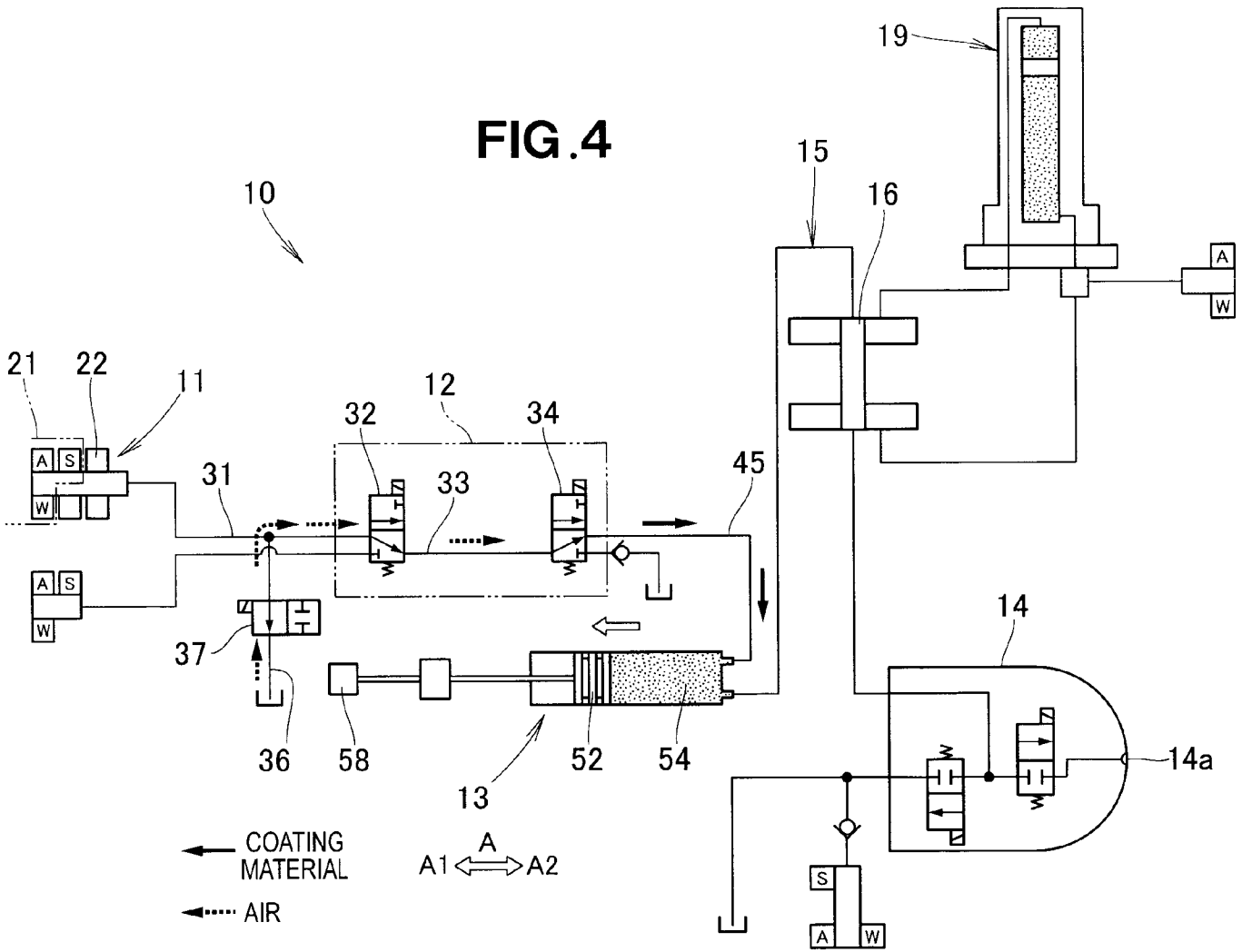
FIG. 4 is a view showing a state in which air is introduced into a feeding path.

Then, as shown in FIG. 4, actuation of the servo motor 58 is continued, and while the piston 52 is moving in the A1 direction, the coating material valve 22 closes and the first dump valve 37 opens. The electrically conductive coating material in the feeding path 45 is thereby drawn into the cylinder chamber 54, and the air replaced by the electrically conductive coating material is introduced into the feeding path 33.

Figure 5:
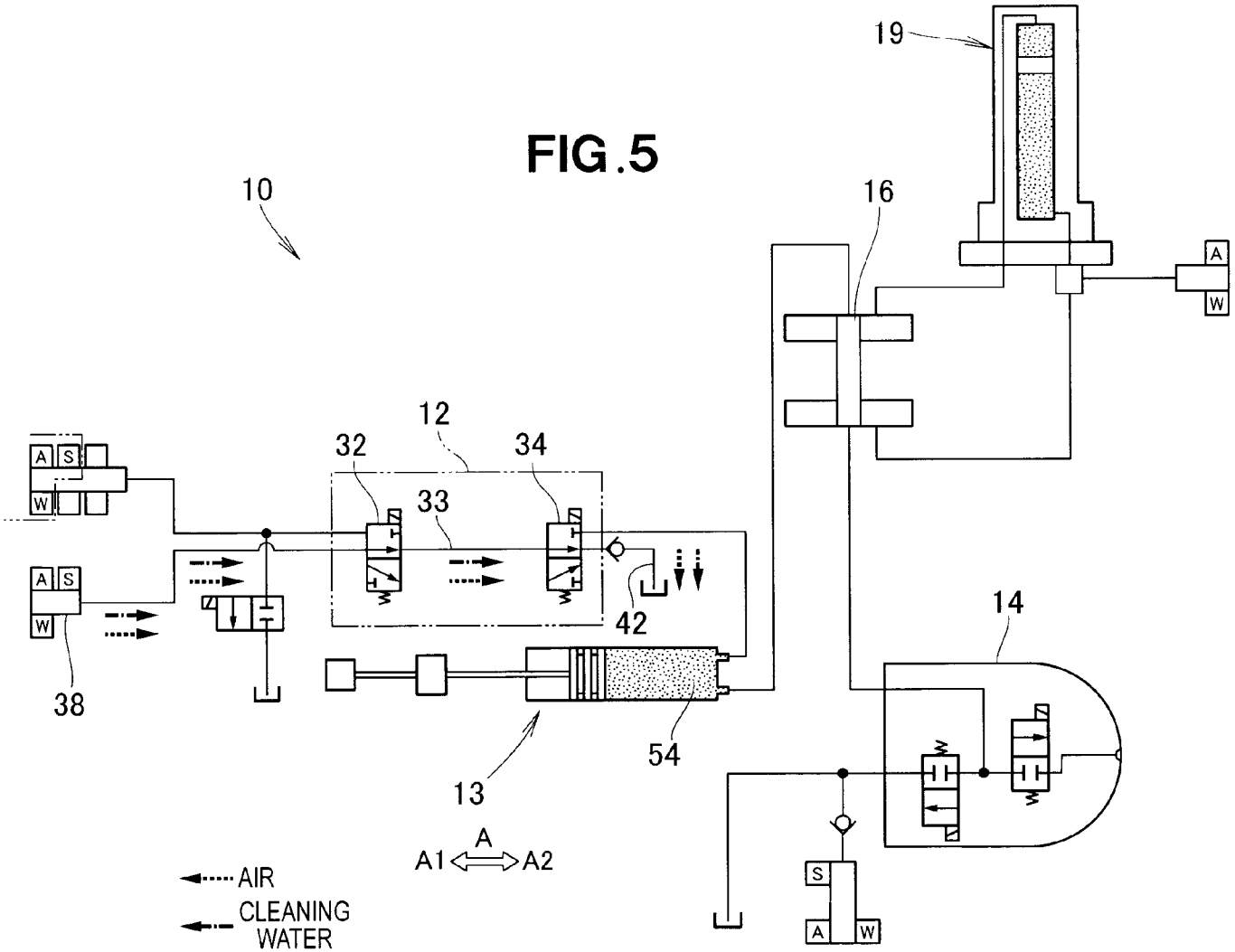
FIG. 5 is a view showing a state in which the feeding path is cleaned by cleaning liquid from a second cleaning valve.

In FIG. 5, after loading of the electrically conductive coating material into the cylinder chamber 54 of the storage tank 13 is completed, the flow paths of the switching valves 32, 34 of the block valve mechanism 12 are switched, the second cleaning valve 38 is opened, cleaning liquid is fed to the feeding path 33 from the second cleaning valve 38, and the feeding path 33 is cleaned. The resultant waste liquid is discharged from the second drainage path 42. Air is also fed from the second cleaning valve 38 to the feeding path 33, and the feeding path 33 is dried. As a result, the switching valves 32, 34 are electrically insulated from each other.

Figure 6:
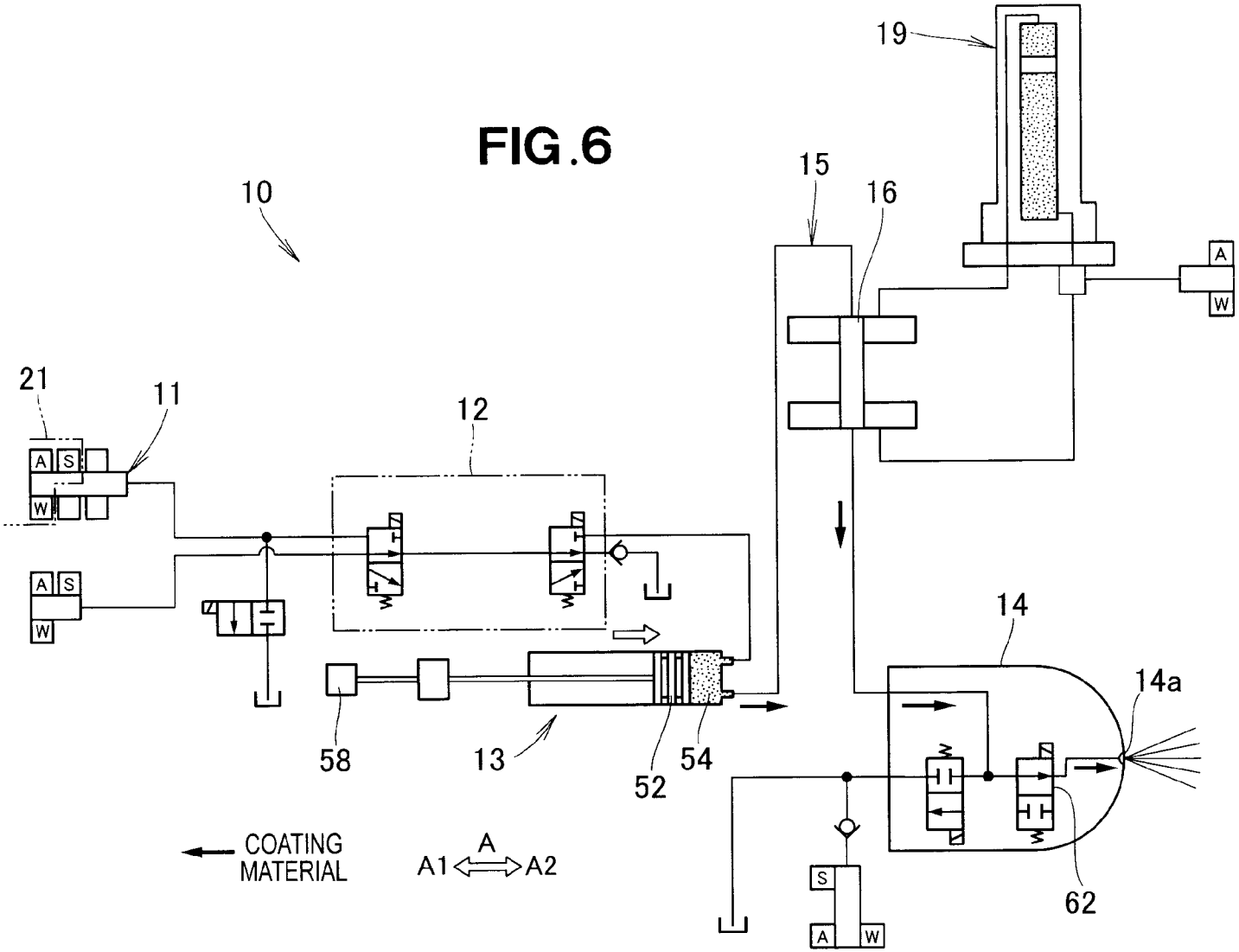
FIG. 6 is a view showing a state in which the electrically conductive coating material is pressure-fed from the storage tank.

As shown in FIG. 6, the trigger valve 62 is opened, the servo motor 58 is driven, and the piston 52 is moved in the A2 direction, whereby the electrically conductive coating material is pressure-fed from the cylinder chamber 54 to the delivery path 15. The electrically conductive coating material is thereby fed to the coating gun 14 through the switching valve 16 and the trigger valve 62 and sprayed from the spray opening 14*a*. A high voltage is also applied to the electrically conductive coating material, and electrostatic coating is performed on a coated object not shown in the drawing.

The operation that occurs when the electrically conductive coating material passes through the switching valve 16 will next be described based on FIG. 7.

As indicated by the arrow A, the electrically conductive coating material that has flowed into the first inlet 115 of the switching valve 16 from the first delivery path 15*a* reaches the top connecting passage 121.

First, air is fed from the air feeding port 125 to the first cylinder hole 95, the male tapered part 101*c* of the first valve 101 is pushed against the female tapered part 95*c* by the pressure of the air and the elastic force of the spring 106, and the passage is closed, but when feeding of air to the first cylinder hole 95 is stopped, the first valve 101 is pushed open by the electrically conductive coating material in the top connecting passage 121 against the elastic force of the spring 106. As a result, the electrically conductive coating material flows into the first cylinder hole 95, and reaches the third cylinder hole 97 through the first connecting passage 123, the intra-duct passage 92*a* of the passage connecting duct 92, and the second connecting passage 127.

Since feeding of air from the air feeding port 129 into the third cylinder hole 97 is also stopped, the third valve 103 is pushed open against the elastic force of the spring 106 by the electrically conductive coating material. The electrically conductive coating material flows through the bottom connecting passage 126 from the third cylinder hole 97 and out to the second delivery path 15*b* from the first outlet 116.

Figure 8:
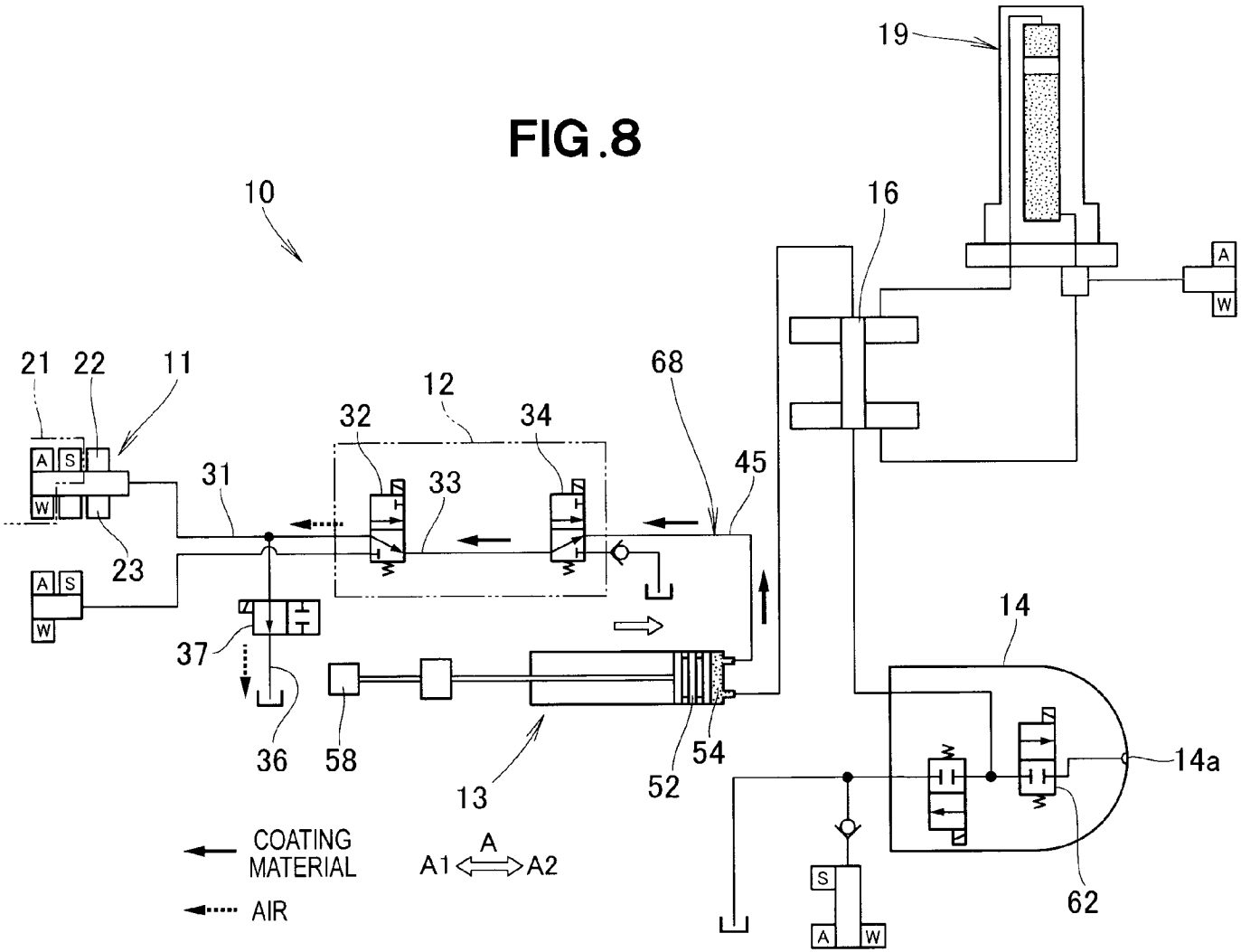
FIG. 8 is a view showing a state in which the electrically conductive coating material remaining in the storage tank temporarily returns toward a block valve mechanism after completion of electrostatic coating.

As shown in FIG. 8, after electrostatic coating is completed, the electrically conductive coating material remaining in the storage tank 13 is temporarily returned toward the block valve mechanism 12.

Specifically, the trigger valve 62 is closed, the switching valves 32, 34 are switched, the feeding paths 31, 33, 45 are connected, the first dump valve 37 is opened, the first drainage path 36 is connected to the feeding path 31, the servo motor 58 is driven, and the piston 52 is moved in the direction of the arrow A2, whereby the electrically conductive coating material in the cylinder chamber 54 is temporarily returned to the feeding paths 45, 33.

At this time, the air in the feeding paths 45, 33 is pushed out to the feeding path 31 by the electrically conductive coating material and discharged from the first drainage path 36.

Consequently, when the coating material valve 22 is then opened and the electrically conductive coating material fed to the feeding path 31 in order to perform electrostatic coating using the same color of electrically conductive coating material, no air is mixed in with the electrically conductive coating material, air can be prevented from entering the storage tank 13, and satisfactory coating quality can be maintained by a simple process.

When an electrically conductive coating material of a different color than the electrically conductive coating material described above is used, after completion of the coating operation described above, application of a high voltage to the coating gun 14 is stopped, the switching valves 32, 34 of the block valve mechanism 12 are switched, and the first cleaning valve 21 is opened, whereby the cleaning liquid is injected into the cylinder chamber 54 of the storage tank 13, and after the cleaning liquid is sent to the coating gun 14 via the delivery path 15 and the switching valve 16 from the cylinder chamber 54, and the inside of the coating gun 14 is cleaned, the cleaning liquid is sprayed to the outside from the spray opening 14*a* and discharged, and the main coating material feeding path 68 from the coating material feeding unit 20 (FIG. 1) to the coating gun 14 is cleaned.

It is sufficient insofar as the electrically conductive coating material of a different color is fed to the cylinder chamber 54 of the storage tank 13 via the coating material valve 23, for example, of the color switch valve mechanism 11, and coating is performed by the same method as previously described.

The operation of feeding the electrically conductive coating material in the coating material cartridge 19 to the coating gun 14 will next be described based on FIGS. 9 through 13.

Figure 9:
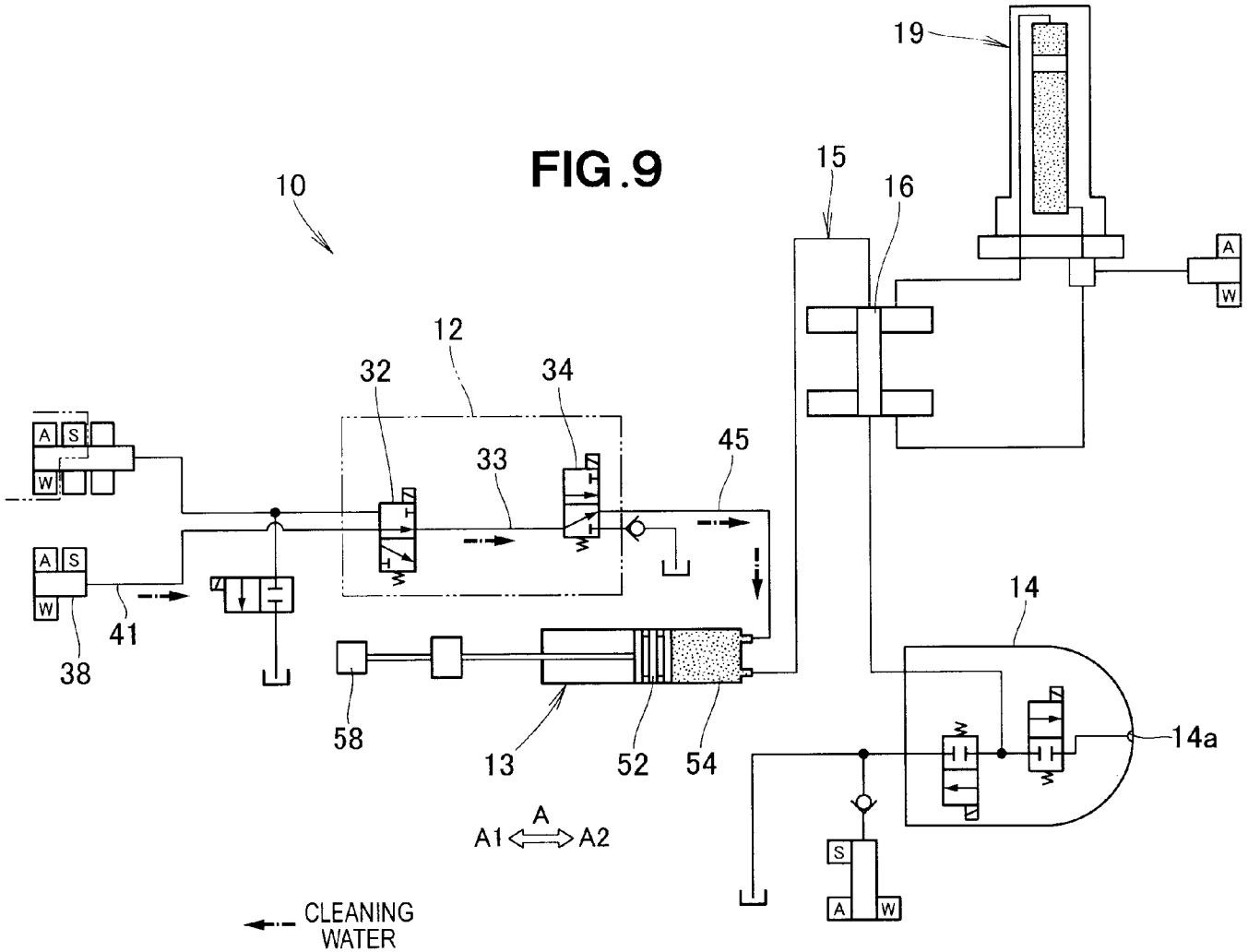
FIG. 9 is a view showing a state in which the feeding path from the second cleaning valve to the storage tank is cleaned when the electrically conductive coating material is fed from the coating material cartridge to a coating gun.

First, as shown in FIG. 9, in a state in which the switching valves 32, 34 of the block valve mechanism 12 are opened, and the second cleaning valve 38 is opened, the servo motor 58 of the storage tank 13 is driven, and the piston 52 is moved in the A1 direction. Water or cleaning liquid is thereby loaded into the cylinder chamber 54 of the storage tank 13 from the second cleaning valve 38 through the feeding paths 41, 33, 45.

Figure 10:
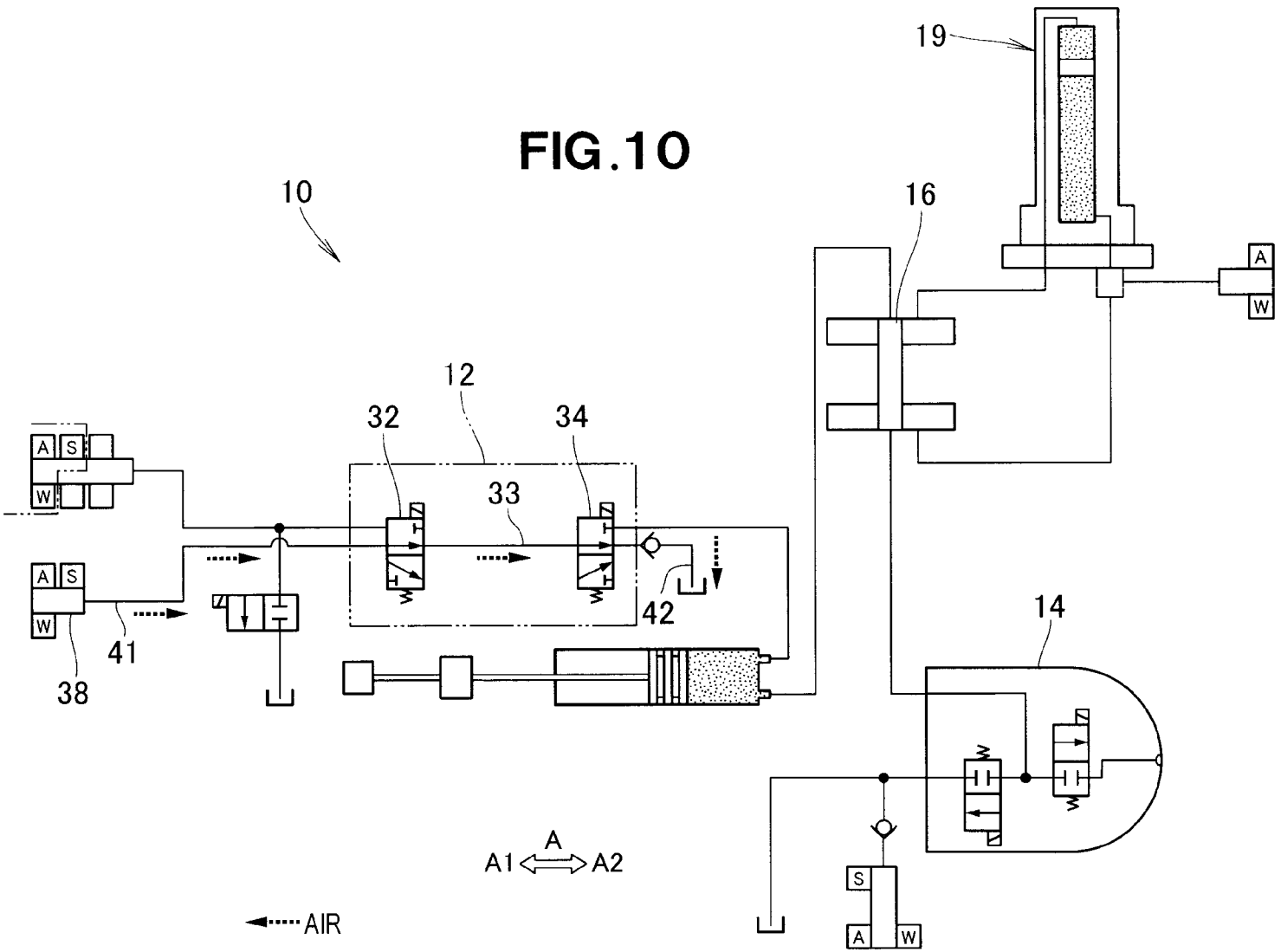
FIG. 10 is a view showing a state in which air is fed from the second cleaning valve, and the feeding path is dried.

As shown in FIG. 10, the flow path of the switching valve 34 of the block valve mechanism 12 is switched, the second cleaning valve 38 is opened, air is fed from the second cleaning valve 38 to the feeding path 33, and the feeding path 33 is dried. As a result, the switching valves 32, 34 are electrically insulated from each other.

Figure 11:
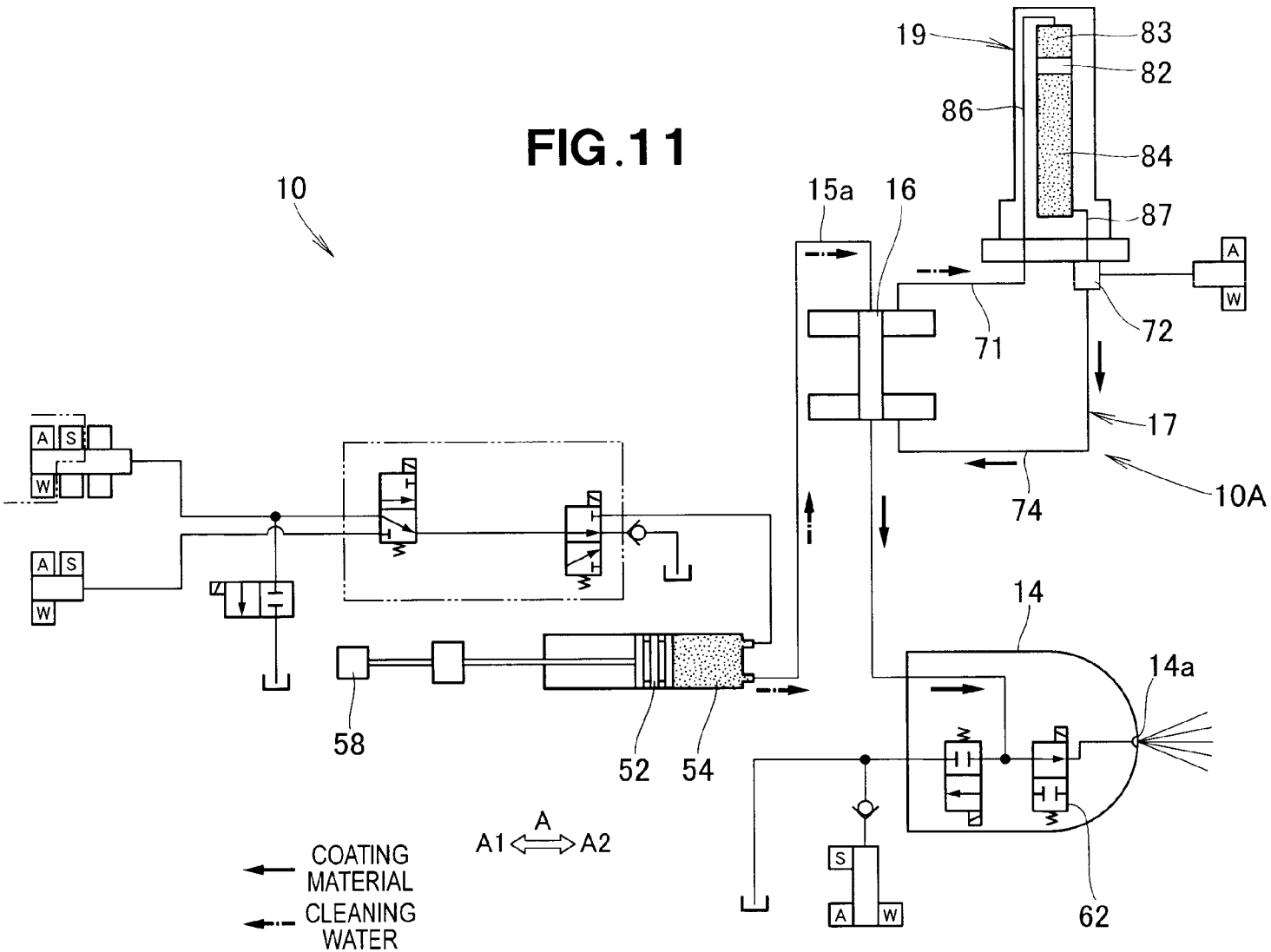
FIG. 11 is a view showing a state in which cleaning liquid is fed into a coating material cartridge from the storage tank.

As shown in FIG. 11, the servo motor 58 is driven, and the piston 52 is moved in the A2 direction, whereby the water or cleaning liquid in the cylinder chamber 54 is sent into the coating material cartridge 19 via the first delivery path 15*a*, the switching valve 16, and the feeding path 71, and fed to the fluid chamber 83 from the fluid passage 86. As a result, the pressure inside the fluid chamber 83 increases, the free piston 82 moves, and the electrically conductive coating material in the coating material chamber 84 is pushed out to the intermediate path 17 via the coating material passage 87.

The electrically conductive coating material is sent to the coating gun 14 through the three-way valve 72 and delivery path 74 of the intermediate path 17, and again through the switching valve 16, and is sprayed from the spray opening 14*a*, whereby electrostatic coating of the coated object is performed.

The operation that occurs when the electrically conductive coating material passes through the switching valve 16 as shown in FIG. 11 will next be described.

Figure 12:
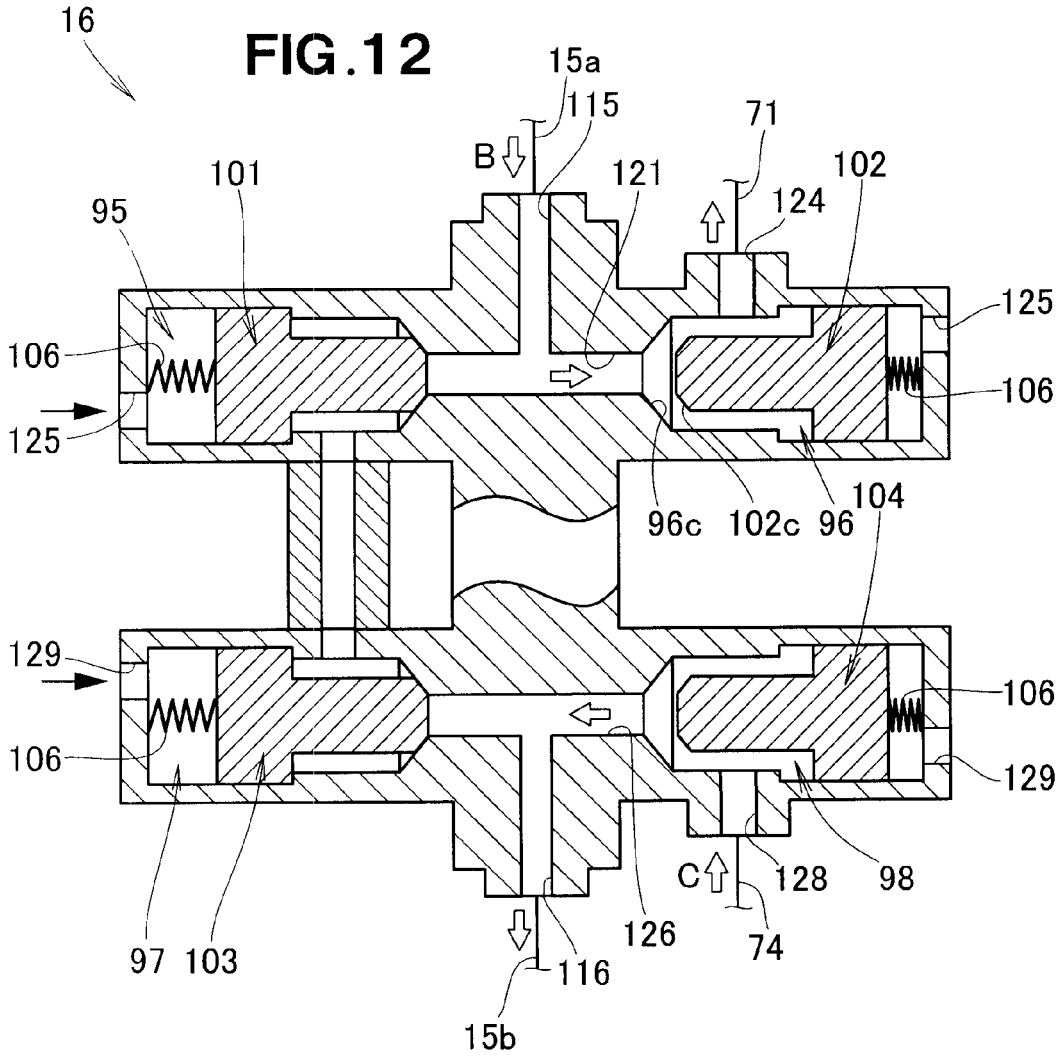
FIG. 12 is a view showing a state in which the electrically conductive coating material passes through the switching valve.

As shown in FIG. 12, the electrically conductive coating material that has flowed into the first inlet 115 of the switching valve 16 from the first delivery path 15*a* as indicated by the arrow B reaches the top connecting passage 121.

First, air is fed from the air feeding port 125 to the second cylinder hole 96, the male tapered part 102*c* of the second valve 102 is pushed against the female tapered part 96*c* by the pressure of the air and the elastic force of the spring 106, and the passage is closed, but when feeding of air to the second cylinder hole 96 is stopped, the second valve 102 is pushed open by the electrically conductive coating material in the top connecting passage 121 against the elastic force of the spring 106. As a result, the electrically conductive coating material flows into the second cylinder hole 96 from the top connecting passage 121 and flows out to the feeding path 71 from the second outlet 124.

As indicated by the arrow C, the electrically conductive coating material that has flows into the second inlet 128 from the delivery path 74 reaches the fourth cylinder hole 98.

Since feeding of air from the air feeding port 129 into the fourth cylinder hole 98 is stopped, the fourth valve 104 is pushed open by the electrically conductive coating material against the elastic force of the spring 106, and the electrically conductive coating material flows through the bottom connecting passage 126 from the fourth cylinder hole 98 and out to the second delivery path 15*b* from the first outlet 116.

Figure 7:
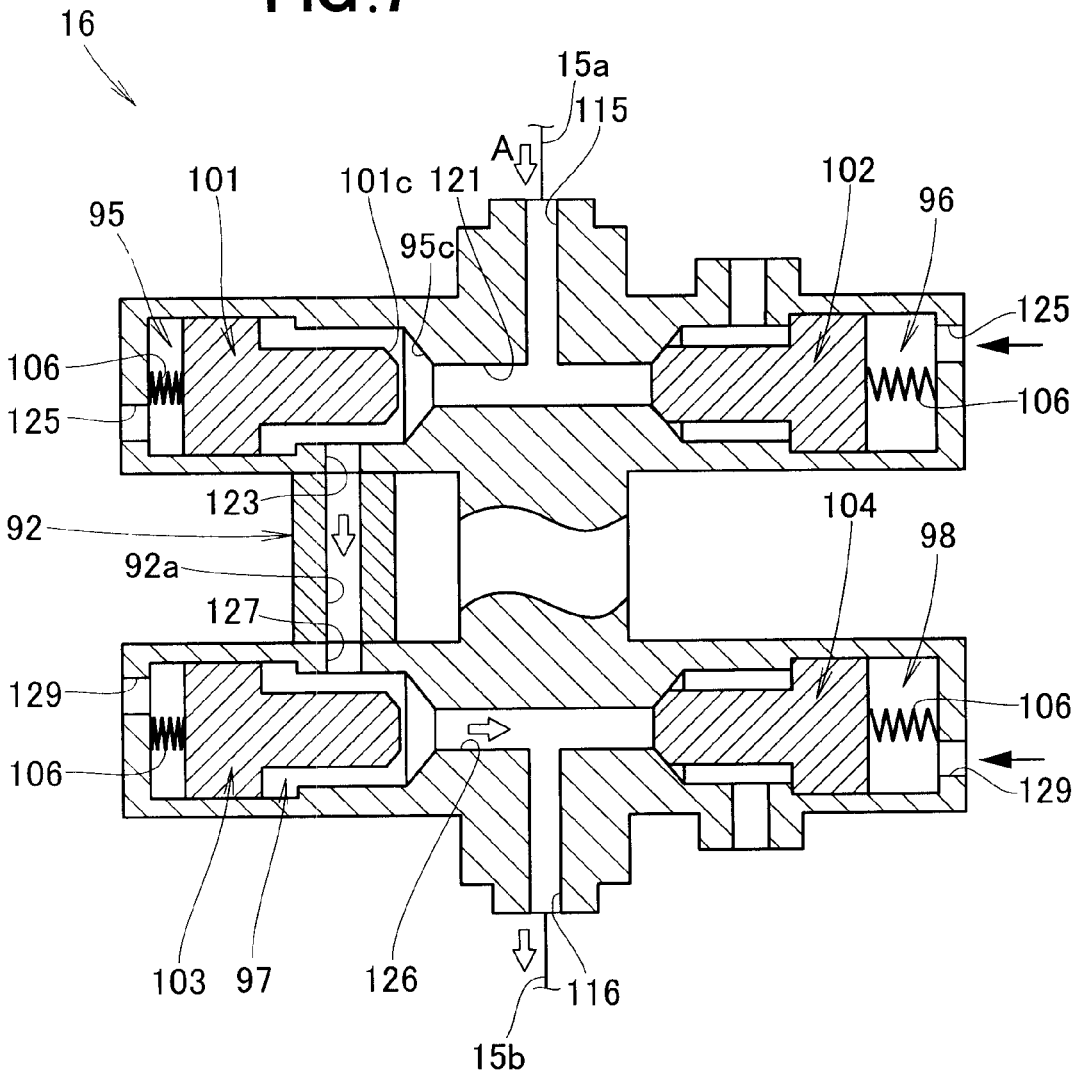
FIG. 7 is a view showing valve movement when the electrically conductive coating material passes through the switching valve.

As described using FIGS. 7 and 12, the switching valve 16 controls feeding and stopping of air to the first through fourth cylinder holes 95 through 98, whereby the first through fourth valves 101 through 104 are easily pushed open by the electrically conductive coating material or the water W, cleaning liquid S, or other fluid, and the flow path of the electrically conductive coating material or the fluid can easily be switched. The structure is also simple, which enables reduced cost.

Cleaning of the sub-coating material feeding path 88 when the coating material cartridge 19 is used will next be described.

Figure 13:
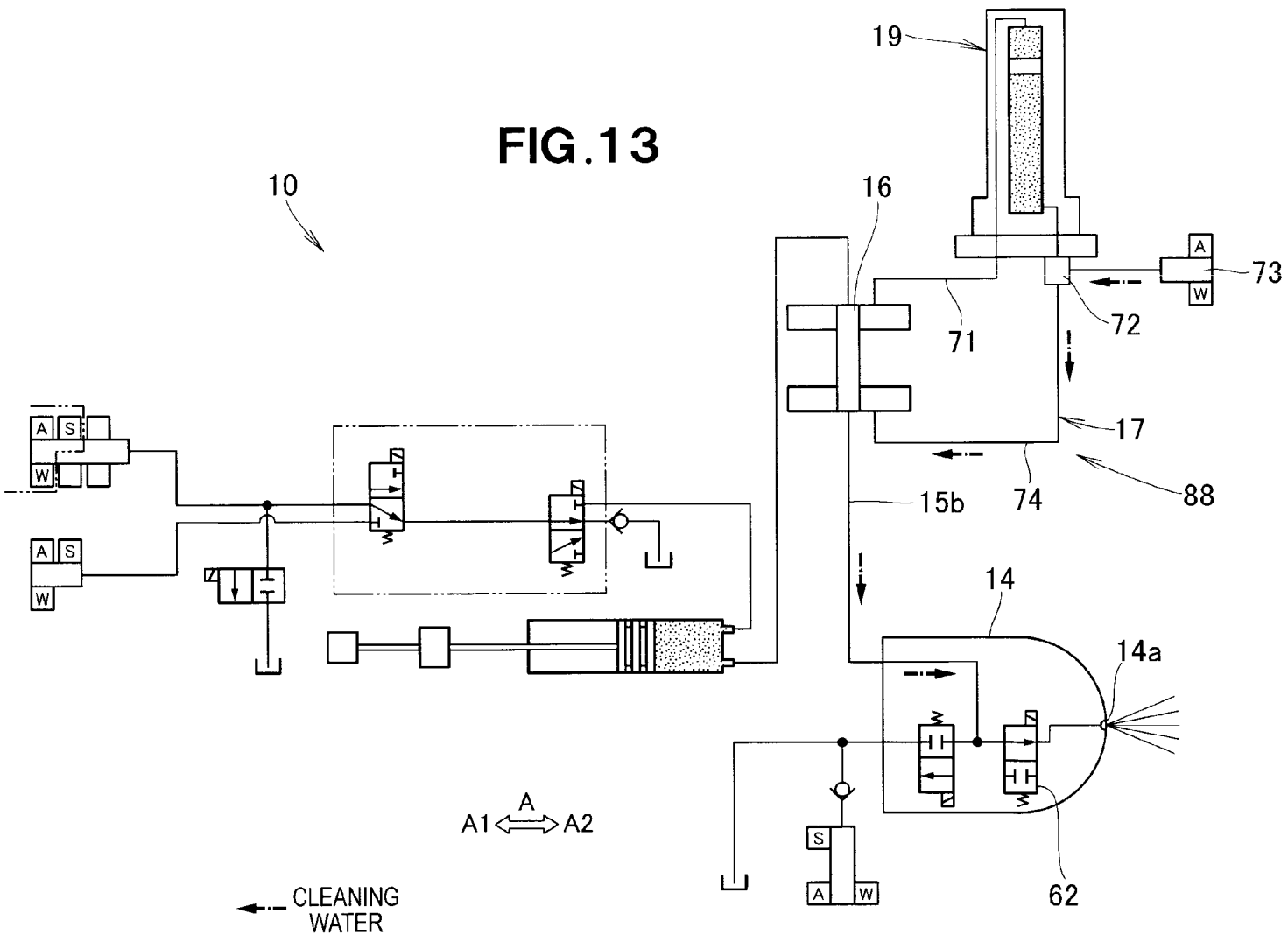
FIG. 13 is a view showing a state in which the feeding path from the coating material cartridge to the coating gun is cleaned.

As shown in FIG. 13, the cleaning liquid is sprayed and discharged from the spray opening 14*a* in a state in which the cleaning valve 73 is opened, cleaning liquid is fed to the sub-coating material feeding path 88 that extends to the coating gun 14 via the three-way valve 72, the delivery path 74, the switching valve 16, and the second delivery path 15*b*, and the trigger valve 62 is opened, and the sub-coating material feeding path 88 extending to the coating gun 14 from the coating material cartridge 19 is cleaned.

As shown in FIGS. 1 and 9 through 13, the present invention is an electrostatic coating method wherein a coating material feeding path for feeding an electrically conductive coating material or a liquid from a coating material feeding unit 20 to a coating gun 14 is provided with a storage part 13 for temporarily storing the electrically conductive coating material or the liquid and pushing out the stored electrically conductive coating material or the liquid toward the coating gun 14; and a block valve mechanism 12 as an insulating part for providing an electrical shield between the coating material feeding unit and the storage part 13; a fluid circuit 10A is provided between the storage part 13 and the coating gun 14; a coating material cartridge 19 is detachably connected to the fluid circuit 10A; and electrostatic coating is performed by applying a high voltage when the electrically conductive coating material is fed from the storage part 13 via the fluid circuit 10A, or applying a high voltage when the electrically conductive coating material is fed from the coating material cartridge 19 via the fluid circuit 10A, and feeding to the coating gun 14 the electrically conductive coating material to which the high voltage is applied; and the electrostatic coating method comprises the steps of feeding the liquid from the coating material feeding unit 20 to the storage part 13 and storing the liquid when the electrically conductive coating material loaded into a coating material chamber 84 inside the coating material cartridge 19 is fed to the coating gun 14; and feeding the liquid in the storage part 13 via the fluid circuit 10A to a fluid chamber 83 that is separated from the coating material chamber 84 by a free piston 82 in the coating material cartridge 19, whereby the free piston 82 is pushed out toward the coating material chamber 84, and the electrically conductive coating material in the coating material chamber 84 is fed to the coating gun 14 by the movement of the free piston 82. Therefore, the water W, cleaning liquid S, or other liquid fed from the coating material feeding unit 20 can be used to feed the electrically conductive coating material in the coating material cartridge 19 to the coating gun 14; there is no need to provide a fluid feeding part for feeding water or cleaning liquid specifically for the coating material cartridge 19, a power source for the fluid feeding part, or a storage part that is provided with the power source; and cost can be reduced.

Since water W or cleaning liquid S can be fed from the coating material feeding unit to the coating material cartridge 19 in the same manner that the coating material feeding path is cleaned by the water W or cleaning liquid S fed from the coating material feeding unit, and there is no need to provide a special method for pushing out the coating material in the coating material cartridge 19, electrostatic coating can be efficiently performed.

The present invention is also an electrostatic coating apparatus 10 wherein a coating material feeding path for feeding an electrically conductive coating material or a liquid from a coating material feeding unit 20 to a coating gun 14 is provided with a storage part 13 for temporarily storing the electrically conductive coating material or the liquid and pushing out the stored electrically conductive coating material or the liquid toward the coating gun 14; and a block valve mechanism 12 for providing an electrical shield between the coating material feeding unit and the storage part 13; and electrostatic coating is performed by feeding to the coating gun 14 the electrically conductive coating material to which a high voltage is applied, or the coating material feeding path is cleaned by feeding the liquid to the coating gun 14; and in the electrostatic coating apparatus, a fluid circuit 10A is provided between the storage part 13 and the coating gun 14, and a coating material cartridge 19 is detachably connected to the fluid circuit 10A; a free piston 82 is provided inside the coating material cartridge 19 so as to be able to move, whereby the coating material cartridge 19 is partitioned into a fluid chamber 83 to which the liquid is fed, and a coating material chamber 84 into which the electrically conductive coating material is loaded; and the electrically conductive coating material inside the coating material chamber is pushed out by the free piston 82 and fed to the coating gun 14 by feeding the liquid that has been fed from the coating material feeding unit and stored in the storage part 13 to the fluid chamber 83 of the coating material cartridge 19 via the fluid circuit 10A. Therefore, the water W, cleaning liquid S, or other liquid fed from the coating material feeding unit can be used to feed the electrically conductive coating material in the coating material cartridge 19 to the coating gun 14; there is no need to provide a fluid feeding part for feeding water or cleaning liquid specifically for the coating material cartridge 19, a power source for the fluid feeding part, or a storage part that is provided with the power source; and cost can be reduced.

Figure 14:
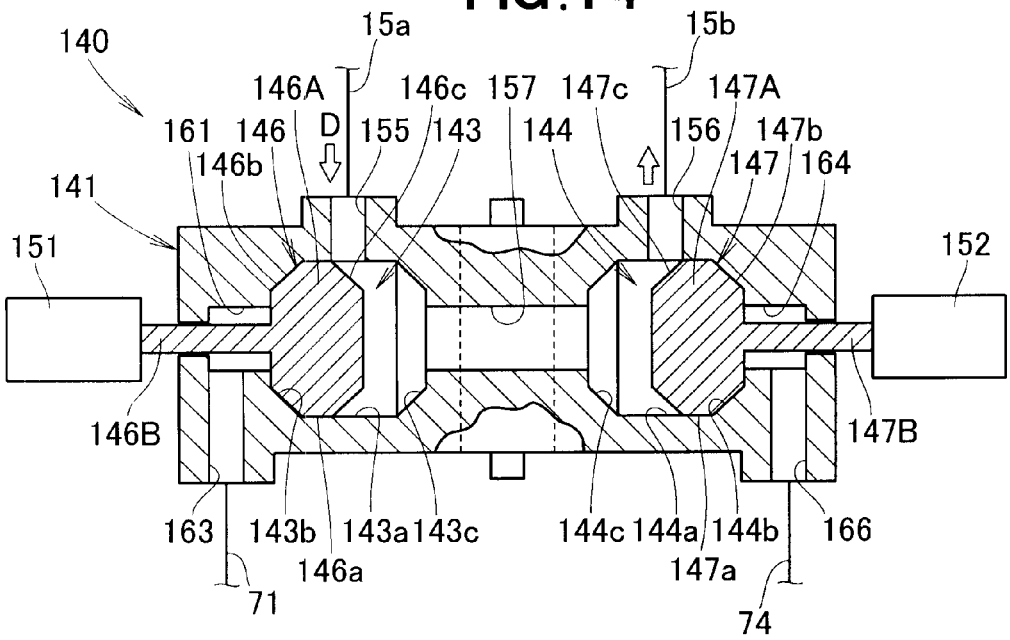
FIGS. 14 and 15 are sectional views showing another embodiment of the switching valve of FIG. 2.
Figure 15:
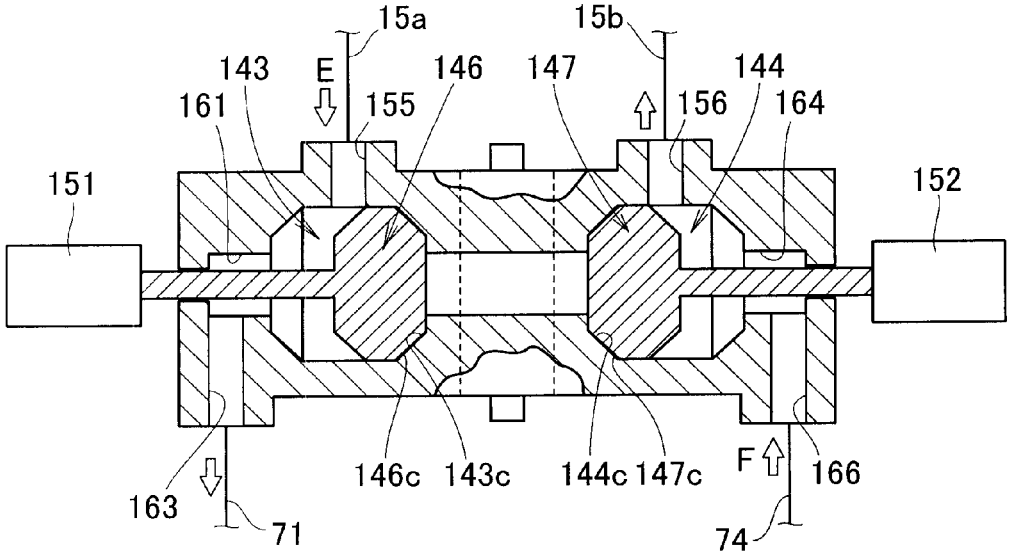

FIGS. 14 and 15 show other embodiments of the switching valve shown in FIG. 2. The same reference numerals are used to refer to components that are the same as those of the switching valve shown in FIG. 2, and no detailed description of such same components will be given.

As shown in FIG. 14, the switching valve 140 is composed of a housing 141 in which a plurality of passages is provided; a first valve 146 and a second valve 147 that are movably inserted in two holes that include a first cylinder hole 143 and a second cylinder hole 144, respectively, formed in the housing 141; and a cylinder-type first actuator 151 and second actuator 152 provided outside the housing 141 in order to open and close the first valve 146 and the second valve 147, respectively.

A first inlet 155 that passes through the first cylinder hole 143; a first outlet 156 that passes through the second cylinder hole 144; a connecting hole 157 for connecting the first cylinder hole 143 and the second cylinder hole 144; a first horizontal hole 161 formed in a position facing the connecting hole 157 with respect to the first cylinder hole 143 and so as to pass through the first cylinder hole 143; a second outlet 163 connected to the first horizontal hole 161; a second horizontal hole 164 formed in a position facing the connecting hole 157 with respect to the second cylinder hole 144 and so as to pass through the second cylinder hole 144; and a second inlet 166 connected to the second horizontal hole 164 are formed in the housing 141.

The first inlet 155 and first outlet 156 described above are connected to the first delivery path 15*a* and the second delivery path 15*b*, respectively. The second outlet 163 is connected to the feeding path 71. The second inlet 166 is connected to the delivery path 74.

The first cylinder hole 143 and the second cylinder hole 144 have large-diameter holes 143*a*, 144*a*, respectively, and female tapered parts 143*b*, 144*b* and female tapered parts 143*c*, 144*c* adjacent to the large-diameter holes 143*a*, 144*a* on both sides thereof.

The first valve 146 is composed of a valve main body 146A and a rod part 146B that is integrally formed with the valve main body 146A, and the rod part 146B is connected to a piston (not shown) that is movably inserted into the first actuator 151.

The valve main body 146A is composed of a large-diameter part 146*a* that is movably fitted into the large-diameter hole 143*a*, and male tapered parts 146*b*, 146*c* formed at both ends of the large-diameter part 146*a* so as to be capable of fitting in the female tapered parts 143*b*, 143*c*, respectively.

The second valve 147 is composed of a valve main body 147A and a rod part 147B that is integrally formed with the valve main body 147A, and the rod part 147B is connected to a piston (not shown) that is movably inserted into the second actuator 152.

The valve main body 147A is composed of a large-diameter part 147*a* that is movably fitted into the large-diameter hole 144*a*, and male tapered parts 147*b*, 147*c* formed at both ends of the large-diameter part 147*a* so as to be capable of fitting in the female tapered parts 144*b*, 144*c*, respectively.

The operation of the switching valve 140 described above will next be described.

As shown in FIG. 14, the first valve 146 is moved by the first actuator 151 so that the male tapered part 146*b* fits into the female tapered part 143*b*. The second valve 147 is moved by the second actuator 152 so that the male tapered part 147*b* fits into the female tapered part 144*b*. The first inlet 155 is thereby communicated with the connecting hole 157 via the first cylinder hole 143, and the connecting hole 157 is communicated with the first outlet 156 via the second cylinder hole 144.

In this state, the electrically conductive coating material is caused to flow into the first inlet 155 from the first delivery path 15*a*, as indicated by the arrow D. As a result, the electrically conductive coating material passes through the first cylinder hole 143 and connecting hole 157 from the first inlet 155 and reaches the second cylinder hole 144, and flows out to the second delivery path 15*b* through the first outlet 156 from the second cylinder hole 144.

As shown in FIG. 15, the first valve 146 is moved by the first actuator 151 so that the male tapered part 146*c* fits into the female tapered part 143*c*. The second valve 147 is moved by the second actuator 152 so that the male tapered part 147*c* fits into the female tapered part 144*c*. The first inlet 155 is thereby communicated with the first horizontal hole 161 and second outlet 163 via the first cylinder hole 143. The second inlet 166 is communicated with the first outlet 156 via the second horizontal hole 164 and second cylinder hole 144.

In this state, the electrically conductive coating material is caused to flow into the first inlet 155 from the first delivery path 15*a*, as indicated by the arrow E. As a result, the electrically conductive coating material flows from the first inlet 155 to the second outlet 163 via the first cylinder hole 143 and the first horizontal hole 161, and flows out to the feeding path 71 from the second outlet 163.

As indicated by the arrow F, the electrically conductive coating material that has flowed into the second inlet 166 from the delivery path 74 flows from the second inlet 166 to the first outlet 156 via the second horizontal hole 164 and the second cylinder hole 144, and flows out to the second delivery path 15*b* from the first outlet 156.

As described using FIGS. 14 and 15, the flow path of the electrically conductive coating material or the liquid can easily be switched by the operation of the first actuator 151 and the second actuator 152 in the switching valve 140 according to the other embodiment described above, and the switching valve 140 has a simple structure. The cost can therefore be reduced.

Although not described using the drawings, when the electrically conductive coating material or the liquid passing through the switched flow path by the operation of the first actuator is sufficiently above a certain pressure, the electrically conductive coating material or the water W, cleaning liquid S, or other liquid easily pushes open the second valve, the flow path of the electrically conductive coating material or the liquid can easily be switched, and the second actuator 152 shown in FIGS. 14 and 15 can be omitted. The structure, weight, and cost can thus be further reduced.

Furthermore, the example of the switching valve 16 shown in FIGS. 7 and 12 does not require such energy as that of the first actuator 151 and the second actuator 152, and merely controls the feeding and stopping of air to the first through fourth cylinder holes 95 through 98, and can therefore be lighter than the switching valve 140 of the other embodiment. There is relatively less load on the 6-axis jointed robot or other retention means for retaining the coating gun 14 and the electrostatic coating apparatus 10 that includes the feeding system for feeding the electrically conductive coating material to the coating gun 14.

Figure 16:
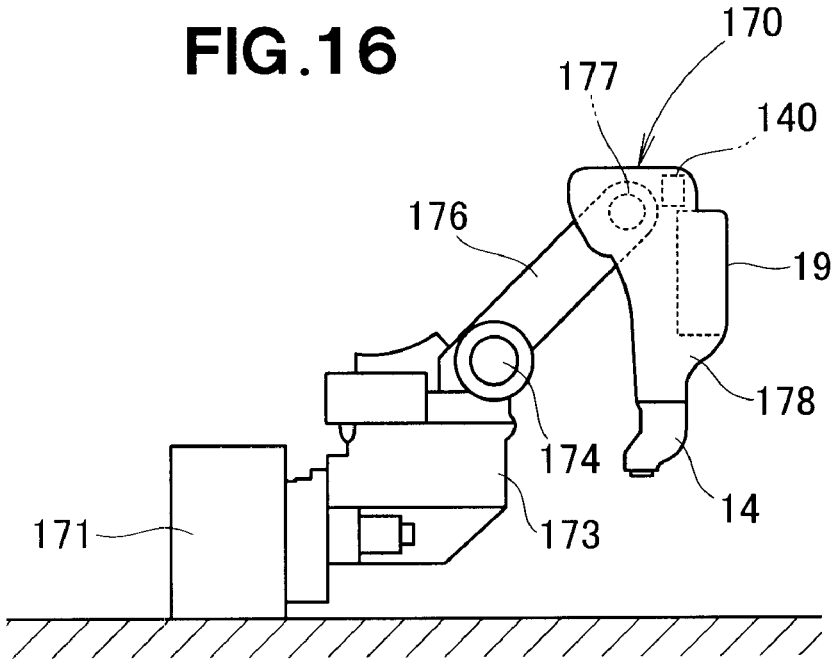
FIG. 16 is a side view showing an articulated robot.

As shown in FIG. 16, the coating gun 14, the coating material cartridge 19, and the switching valve 140 are mounted on an articulated coating robot 170.

The coating robot 170 is composed of a base part 173 movably attached to a rail member 171; a first arm unit 176 attached to the base part 173 so as to be able to swing vertically via a support shaft 174; and a second arm unit 178 attached to the first arm unit 176 so as to be able to swing via a support shaft 177. The coating gun 14 is attached to one end of the second arm unit 178, the switching valve 140 is attached to the other end, and the coating material cartridge 19 is detachably attached to the center part of the second arm unit 178. The switching valve 16 shown in FIG. 2 may be mounted on the coating robot 170 instead of the switching valve 140 described above.

Figure 17:
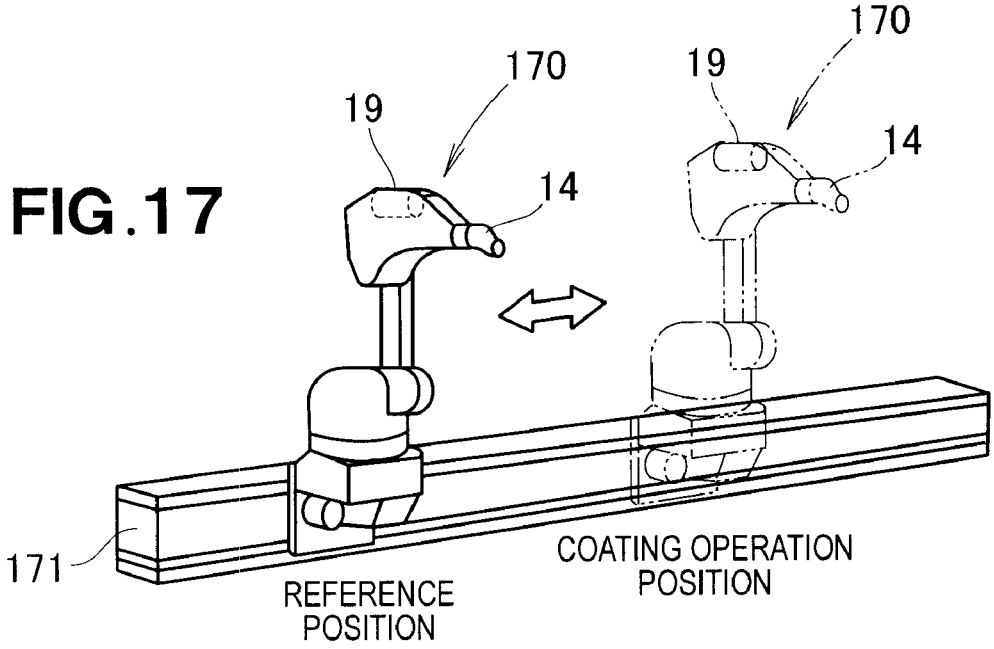
FIG. 17 is a perspective view showing movement of the articulated robot.
Figure 18:
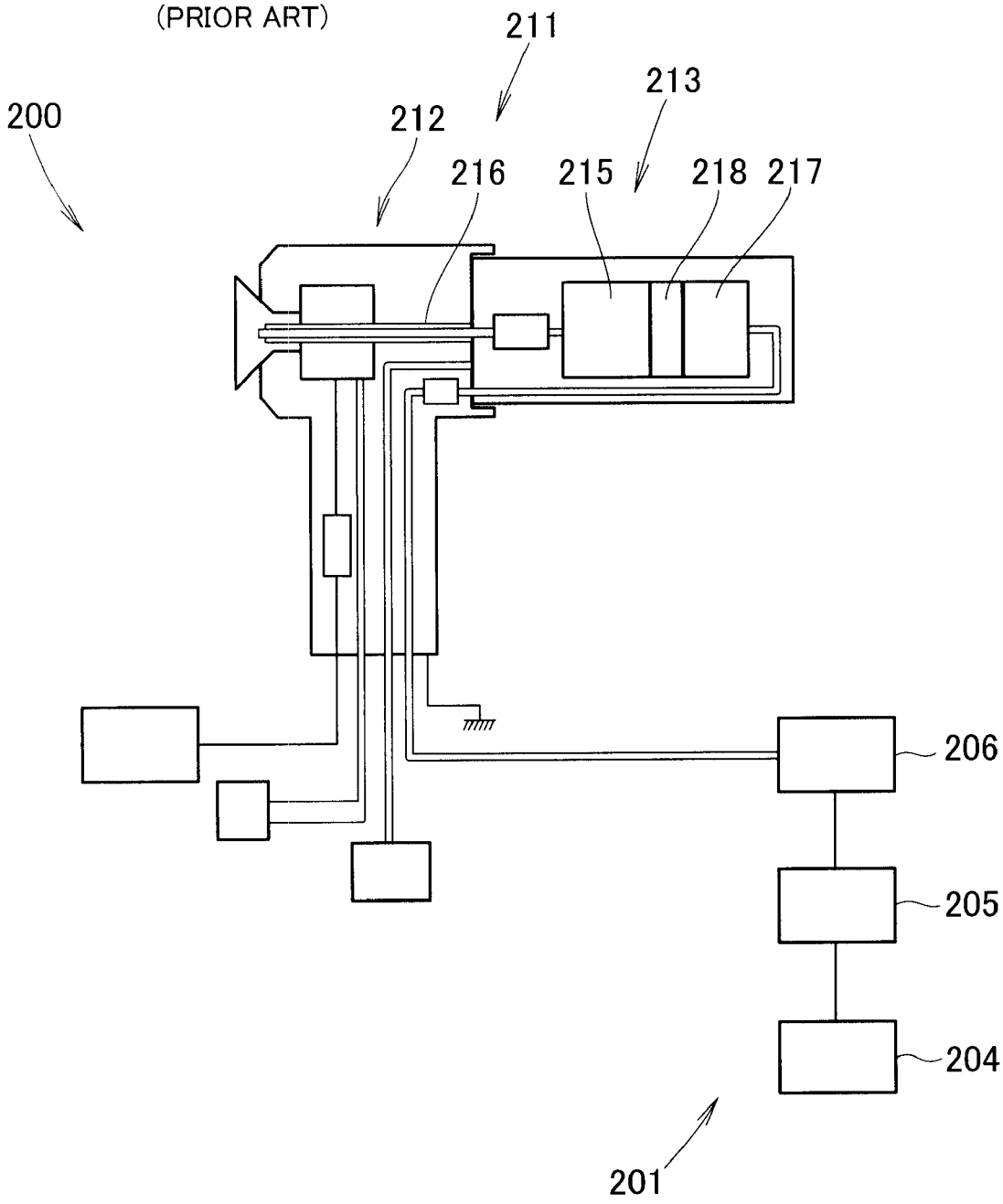
FIG.18 (PRIOR ART)
FIG. 18 is a view showing a conventional coating system.

As shown in FIG. 17, the coating material cartridge 19 is attached and detached with respect to the coating robot 170 at a reference position indicated by solid lines, and the coating robot 170 moves on the rail member 171 from the reference position to a coating operation position indicated by double-dashed lines, and performs electrostatic coating.

INDUSTRIAL APPLICABILITY

The electrostatic coating method and apparatus according to the present invention are particularly suitable for electrostatic coating of an automobile.

The invention claimed is:

1. An electrostatic coating method wherein a coating material feeding path for feeding an electrically conductive coating material or a fluid from a coating material feeding unit to a coating gun has a storage part for temporarily storing the electrically conductive coating material or the fluid and pushing out the stored electrically conductive coating material or the fluid toward the coating gun, and an insulating part for providing an electrical shield between the coating material feeding unit and the storage part; a fluid circuit is provided between the storage part and the coating gun; a coating material cartridge is detachably connected to the fluid circuit; and electrostatic coating is performed by applying a voltage when the electrically conductive coating material is fed from the storage part via the fluid circuit, or applying a voltage when the electrically conductive coating material is fed from the coating material cartridge via the fluid circuit, and feeding to the coating gun the electrically conductive coating material to which the voltage is applied, the method comprising the steps of:

feeding the fluid from the coating material feeding unit to the storage part and storing the fluid when the electrically conductive coating material loaded into a coating material chamber inside the coating material cartridge is fed to the coating gun; and feeding the fluid in the storage part via the fluid circuit to a fluid chamber that is separated from the coating material chamber by a free piston in the coating material cartridge, whereby the free piston is pushed toward the coating material chamber, and the electrically conductive coating material in the coating material chamber is fed to the coating gun by the movement of the free piston.

2. An electrostatic coating apparatus wherein a coating material feeding path for feeding an electrically conductive coating material or a fluid from a coating material feeding unit to a coating gun has a storage part for temporarily storing the electrically conductive coating material or the fluid and pushing out the stored electrically conductive coating material or the fluid toward the coating gun, and an insulating part for providing an electrical shield between the coating material feeding unit and the storage part; and electrostatic coating is performed by feeding to the coating gun the electrically conductive coating material to which a voltage is applied, or the coating material feeding path is cleaned by feeding the fluid to the coating gun, the apparatus comprising:

a fluid circuit provided between the storage part and the coating gun, and a coating material cartridge is detachably connected to the fluid circuit;

a free piston provided inside the coating material cartridge so as to be able to move, whereby the coating material cartridge is partitioned into a fluid chamber to which the fluid is fed, and a coating material chamber into which the electrically conductive coating material is loaded; and the electrically conductive coating material inside the coating material chamber being pushed by the free piston and fed to the coating gun by feeding the fluid that has been fed from the coating material feeding unit and stored in the storage part to the fluid chamber of the coating material cartridge via the fluid circuit.

3. An electrostatic coating apparatus wherein a coating material feeding path for feeding an electrically conductive coating material or a fluid from a coating material feeding unit to a coating gun has a storage part for temporarily storing the electrically conductive coating material or the fluid and pushing out the stored electrically conductive coating material or the fluid toward the coating gun, and an insulating part for providing an electrical shield between the coating material feeding unit and the storage part; and electrostatic coating is performed by feeding to the coating gun the electrically conductive coating material to which a voltage is applied, or the coating material feeding path is cleaned by feeding the fluid to the coating gun, the apparatus comprising:

a fluid circuit provided between the storage part and the coating gun, and a coating material cartridge is detachably connected to the fluid circuit;

a free piston provided inside the coating material cartridge so as to be able to move, whereby the coating material cartridge is partitioned into a fluid chamber to which the fluid is fed, and a coating material chamber into which the electrically conductive coating material is loaded; and the electrically conductive coating material inside the coating material chamber being pushed by the free piston and fed to the coating gun by feeding the fluid that has been fed from the coating material feeding unit and stored in the storage part to the fluid chamber of the coating material cartridge via the fluid circuit, wherein a flow path switching device is provided to the fluid circuit, and the flow path switching device comprises:

a first inlet and a second inlet into which the fluid flows;

a first outlet and a second outlet out of which said fluid flows;

a first cylinder hole communicating with the first inlet;

a second cylinder hole communicating with the first inlet and the second outlet;

a third cylinder hole communicating with the first outlet;

a fourth cylinder hole communicating with the first outlet and the second inlet;

an inter-cylinder hole passage for connecting each of the first cylinder hole and the third cylinder hole;

a first valve, a second valve, a third valve, and a fourth valve that are movably inserted in the first cylinder hole, the second cylinder hole, the third cylinder hole, and the fourth cylinder hole, respectively; and urging means for urging each of the first valve, the second valve, the third valve, and the fourth valve in the closing direction, wherein the first valve opens and closes a passage between the first cylinder hole and the first inlet, the second valve opens and closes a passage between the second cylinder hole and the first inlet, the third valve opens and closes a passage between the third cylinder hole and the first outlet, and the fourth valve opens and closes a passage between the fourth cylinder hole and the first outlet.

4. The electrostatic coating apparatus of claim 3, wherein the urging means comprises springs for pushing each of the first valve, the second valve, the third valve and the fourth valve closed, and pressurized fluid fed to each of the first cylinder hole, the second cylinder hole, the third cylinder hole, and the fourth cylinder hole.

5. The electrostatic coating apparatus according to claim 3, wherein the coating gun and the flow path switching device are mounted on an arm of an articulated robot capable of freely varying the spray direction of the electrically conductive coating material in the coating gun.

6. An electrostatic coating apparatus wherein a coating material feeding path for feeding an electrically conductive coating material or a fluid from a coating material feeding unit to a coating gun has a storage part for temporarily storing the electrically conductive coating material or the fluid and pushing out the stored electrically conductive coating material or the fluid toward the coating gun, and an insulating part for providing an electrical shield between the coating material feeding unit and the storage part; and electrostatic coating is performed by feeding to the coating gun the electrically conductive coating material to which a voltage is applied, or the coating material feeding path is cleaned by feeding the fluid to the coating gun, the apparatus comprising:

a fluid circuit provided between the storage part and the coating gun, and a coating material cartridge is detachably connected to the fluid circuit;

a free piston provided inside the coating material cartridge so as to be able to move, whereby the coating material cartridge is partitioned into a fluid chamber to which the fluid is fed, and a coating material chamber into which the electrically conductive coating material is loaded; and the electrically conductive coating material inside the coating material chamber being pushed by the free piston and fed to the coating gun by feeding the fluid that has been fed from the coating material feeding unit and stored in the storage part to the fluid chamber of the coating material cartridge via the fluid circuit, wherein a flow path switching device is provided to the fluid circuit, and the flow path switching device comprises:

a first inlet and a second inlet into which the fluid flows;

a first outlet and a second outlet out of which said fluid flows;

a first cylinder hole communicating with the first inlet and the second outlet;

a second cylinder hole communicating with the first outlet and the second inlet;

a connecting hole for connecting each of the first cylinder hole and the second cylinder hole;

a first valve and a second valve movably inserted into the first cylinder hole and the second cylinder hole, respectively; and actuators for moving each of the first valve and the second valve in at least one direction, the first valve being for opening and closing a passage between the first inlet and the connecting hole and between the first inlet and the second outlet, the second valve being for opening and closing a passage between the connecting hole and the first outlet and between the second inlet and the first outlet.

7. The electrostatic coating apparatus of claim 6, wherein the actuators comprise a pair of first and second actuators for moving the first and second valves, respectively.

* * * * *